US008714719B2

(12) United States Patent
Mauck et al.

(10) Patent No.: US 8,714,719 B2
(45) Date of Patent: May 6, 2014

(54) PRINTHEAD UNIT ASSEMBLY FOR USE WITH AN INKJET PRINTING SYSTEM

(71) Applicant: Kateeva, Inc., Menlo Park, CA (US)

(72) Inventors: Justin Mauck, Belmont, CA (US); Alexander Sou-Kang Ko, Santa Clara, CA (US); Eliyahu Vronsky, Los Altos, CA (US)

(73) Assignee: Kateeva, Inc., Menlo Park, CA (US)

( * ) Notice: Subject to any disclaimer, the term of this patent is extended or adjusted under 35 U.S.C. 154(b) by 0 days.

(21) Appl. No.: 13/839,993

(22) Filed: Mar. 15, 2013

(65) Prior Publication Data

US 2013/0321535 A1 Dec. 5, 2013

Related U.S. Application Data

(60) Provisional application No. 61/625,659, filed on Apr. 17, 2012, provisional application No. 61/646,159, filed on May 11, 2012, provisional application No. 61/697,479, filed on Sep. 6, 2012.

(51) Int. Cl.
*B41J 2/175* (2006.01)

(52) U.S. Cl.
USPC ..... 347/85

(58) Field of Classification Search
USPC ..... 347/19, 84, 85, 86, 87
See application file for complete search history.

(56) References Cited

U.S. PATENT DOCUMENTS

| | | | | |
|---|---|---|---|---|
| 4,872,027 | A * | 10/1989 | Buskirk et al. | 347/19 |
| 5,786,829 | A * | 7/1998 | Pasciak et al. | 347/28 |
| 5,808,643 | A * | 9/1998 | Tracy et al. | 347/92 |
| 6,305,786 | B1 | 10/2001 | Plotkin et al. | |
| 6,406,120 | B2 | 6/2002 | Pauschinger | |
| 6,799,842 | B2 * | 10/2004 | Barinaga et al. | 347/85 |
| 2006/0007280 | A1 | 1/2006 | Ang | |
| 2011/0149000 | A1 | 6/2011 | Albertalli et al. | |

OTHER PUBLICATIONS

International Search Report and Written Opinion issued on Jun. 5, 2013, to PCT Application No. PCT/US2013/032451.

* cited by examiner

*Primary Examiner* — Anh T. N. Vo

(57) ABSTRACT

Features for various embodiments of a self-contained printhead unit, including an on-board fluidic system, quick-coupling electrical and pneumatic interfacing, in conjunction with the features of various embodiments of a kinematic mounting and air bearing clamping assembly, as well as contactless integration to a waste assembly, together provide for the ready interchangeability of a plurality of printhead units in a printing system during a printing process, while at the same time preventing cross-contamination of a plurality of end-user selected inks contained in each of a plurality of printhead units.

14 Claims, 23 Drawing Sheets

PRINTHEAD UNIT ASSEMBLY FOR USE WITH AN INKJET PRINTING SYSTEM

CROSS-REFERENCE TO RELATED APPLICATIONS

This application claims the benefit of U.S. Provisional Application 61/625,659, filed Apr. 17, 2012, as well as claiming the benefit of U.S. Provisional Application 61/646,159, filed May 11, 2012, and additionally claims the benefit of U.S. Provisional Application 61/697,479, filed Sep. 6, 2012. All cross-referenced applications listed herein are incorporated by reference in their entirety.

FIELD

The field of the present teachings relates to an interchangeable printhead unit assembly for use in an industrial inkjet thin film printing system.

BACKGROUND

According to the present teachings, various embodiments of a printhead unit assembly can include a printhead unit, mounting and clamping assembly, and an interface assembly. For various embodiments of a printhead unit assembly of the present teachings, a printhead unit and a mounting and clamping assembly can provide for repeatable strain-free, positioning of a printhead unit in a printing system. In various embodiments of a printhead unit assembly of the present teachings, a printhead unit and an interface assembly can have features that enable the ready interchangeability of various printhead units with a printing system. The ready interchangeability providing strain-free, repeatable positioning of a printhead unit in a printing system enables flexibility in creating targeted thin film processes, as well as reliable high-throughput production printing.

DETAILED DESCRIPTION

Figure 1:
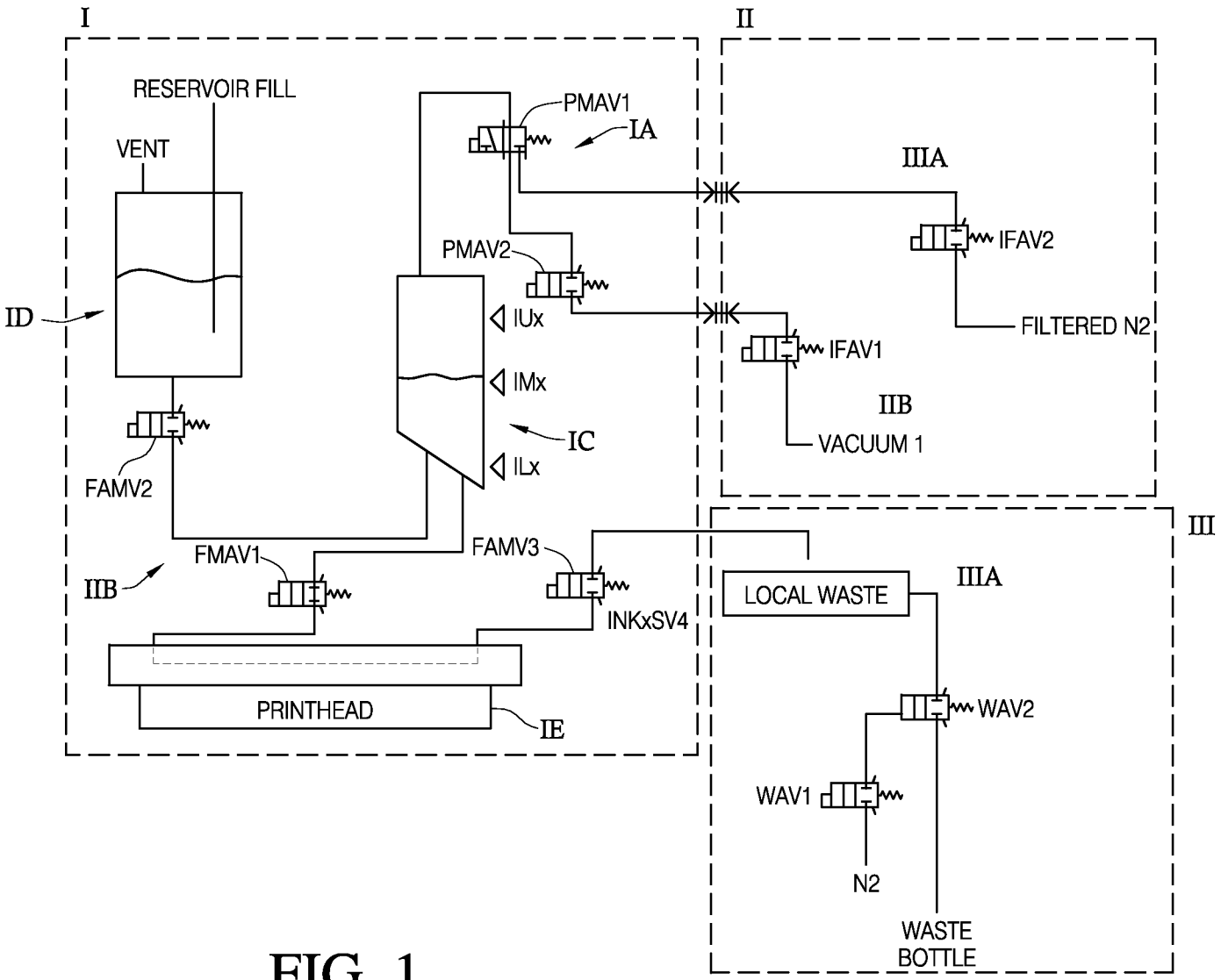
FIG. 1 is a block diagram of a printhead unit according to various embodiments of a printhead unit of the present teachings, which depicts associated pneumatic control and waste assemblies.

The present teachings disclose embodiments of a printhead unit assembly for use in an industrial inkjet thin film printing system that can be used for various printing processes. Various embodiments of a printhead unit assembly of the present teachings can include a printhead unit, a mounting and clamping assembly, and an interface assembly. According to the present teachings, devices, apparatuses, systems and methods disclosed herein can be useful, for example, but not limited by, developing various printing processes, as well as providing for efficient production scale printing.

In that regard, it was contemplated that desirable attributes for a printhead unit assembly for use in, for example, but not limited by, the manufacture of an OLED panel substrate using inkjet printing processes, could include providing end-user flexibility for the efficient sequential printing of a variety of inks of various formulations on a substrate during a print process. However, while providing sequential printing of a plurality of inks during a printing process is desirable, cross-contamination of the plurality of inks and ink formulations is not desirable. As such, a design implementing efficient sequential printing of a variety of inks of various formulations should additionally eliminate cross-contamination.

With respect to positioning of a printhead unit that is constantly moved in and out of a printing system, it is desirable that mounting and clamping provide for strain-free, repeatable positioning of a printhead unit, as well as providing for fully automated printhead exchange. As used herein, strain-free refers to substantially reducing, if not essentially eliminating a lateral force that could cause untoward displacement of a printhead unit in a mounting and clamping assembly. With respect to a flexible movement of a printhead unit in and out of a printing system, the types of interconnections required from a printing system to a printhead unit, such as electrical, pneumatic and fluidic, can pose problems with respect to providing rapid and efficient interchange of various printhead units. Given the number of printhead units that can constantly be moved in and out of a printing system, providing identification of each printhead unit and its operation information can be used to prevent selection errors during automated exchange of printhead units. Moreover, the design of the printhead unit assembly should provide for robustness of the printhead unit during use, as well as ease of maintenance in order to avoid substantial down-time.

Accordingly, in contemplating attributes and challenges, various embodiments of printhead unit assemblies and systems of the present teachings can include a self-contained printhead unit, a mounting and clamping assembly for mounting a printhead unit onto a printing system to provide repeatable, strain-free printhead unit positioning, and an interface assembly providing rapid and automated electrical and pneumatic interconnections. Such components were designed to provide efficient and reliable printing processes for inkjet printing of thin films, for example, but not limited by, the inkjet printing of organic light emitting diode (OLED) thin films. Additionally, various embodiments of printhead unit assemblies and systems of the present teachings can provide for identification and tracking of printhead units, as well as providing for ease of maintenance for various embodiments of a printhead unit of the present teachings.

For various embodiments of a printhead unit of the present teachings, each of a printhead unit can be a self-contained assembly, of which a plurality of self-contained printhead units can be readily interchanged into a printing system during a printing process. Various embodiments of a self-contained printhead unit can have a fluidic system that can include a pneumatic manifold block assembly, a fluidic manifold block assembly, and a primary dispensing reservoir, which can be in fluid communication with the pneumatic and fluidic manifolds. Various embodiments of a printhead unit can have a fluidic system that further includes a bulk ink reservoir that can be in fluid communication with the primary dispensing reservoir. Various embodiments of a bulk ink reservoir can have an inlet port, and a vent that can allow for filling the bulk ink reservoir. Filling of a bulk ink reservoir can be done in a manual or automated mode. In various embodiments, filling of a bulk ink reservoir can be done by periodically supplying ink from an external supply source into the bulk ink reservoir via a supply port joined to the bulk ink reservoir inlet port via a physical connector reversibly attached prior to such refilling and detached after such refilling. In various embodiments filling of a bulk ink reservoir can be done by periodically supplying ink from an external supply source into the bulk ink reservoir via a supply port proximal to the inlet port through which ink can be directed from the external supply without the use of a physical connector to join the supply port and the inlet port.

Various embodiments of a self-contained printhead unit can have a bulk ink reservoir, which can have a volume sufficient to provide a continuous supply of ink to a primary dispensing reservoir over the course of a printing process. The continuous supply of ink to a primary dispensing reservoir can maintain a constant volume in a primary dispensing reservoir, which during printing can be fluid communication with a printhead. As such, a constant volume in a primary dispensing reservoir can provide for negligible variations in pressure of ink at a plurality of printhead nozzles in a printhead. In that regard, various embodiments of a printhead unit include at least one liquid level indicator for maintaining a defined fill level for the primary dispensing reservoir, so that ink from the bulk ink reservoir continuously replenishes the primary dispensing reservoir to a defined fill level during printing. In various embodiments, periodic supplying of ink from an external supply to the bulk ink reservoir may occur between printing operations in a maintenance location. Accordingly, a self-contained printhead unit not requiring tubing connections from a source external the printhead unit for an ink supply can eliminate the need for cumbersome tubing disconnections and reconnections during exchange of various printhead units, and can further eliminate the need for cumbersome tubing lines being provided to the printheads during active printing operations.

Various embodiments of a manifold assembly of the present teachings can have a plurality of channels fabricated internal a manifold assembly, as well as a plurality of ports providing for fluid communication, for example, but not limited by, between the channels and a plurality of valves providing fluid control. As such, various embodiments of manifold assemblies of the present teachings can provide for fluidic distribution and control. For various embodiments of a printhead unit assembly according to the present teachings, each component in communication with a manifold, for example, but not limited by, a manifold, a valve, a reservoir, a vacuum source, a gas source, such as an inert gas source, an inkjet printhead assembly, and the like, that are in communication with a port can mounted on a manifold and can be sealed using an O-ring seal, precluding the use of tubing connections thereby. As such, various embodiments of a manifold assembly of the present teachings can minimize undesirable dead volumes, as well as increase printhead unit robustness by avoiding failure modes common to various tubing and tubing connections.

In various embodiments of a printhead unit, each of a plurality of interchangeable printhead units can have a unique identification or recognition code. For various embodiments, the identification or recognition code can be indicated physically on a printhead unit, as well as electronically associated with each printhead unit. For various embodiments of a printhead unit, the identification or recognition code can associate each unit with a unique set of operational information for each printhead unit. For example, but not limited by, the unique operational information can include a unique location of a printhead unit in a maintenance module, the ink formulation contained in the printhead unit, and printhead calibration data. Such unique operational information can be stored on a memory device. For various embodiments, the memory device can be an on-board memory device that travels with each printhead unit.

Various embodiments of a printhead unit can include a quick-coupling electrical interface plate that mates with an interface assembly of a printing system for ready interchange into and out of a mounting and clamping assembly. Various embodiments of a mounting and clamping assembly can be affixed to a printing system, as part of a motion system for controlling the printhead unit position relative to a substrate. Further, various embodiments of a printhead unit according to the present teachings can have an adapter plate manifold block assembly adjoining a fluidic manifold block. Various embodiments of an adapter plate manifold block assembly of the present teachings can provide for fluid communication between a fluidic manifold block and a printhead, as well as providing for attachment of a printhead assembly to an adapter plate manifold block assembly. Additionally, various embodiments of an adapter plate manifold block assembly can include a mating surface for mounting a printhead unit into a mounting and clamping assembly. In various embodiments of an industrial inkjet thin film printing system, a mounting and clamping assembly can provide for the kinematic mounting of a printhead unit to an industrial inkjet thin film printing system, as well as providing strain-free clamping. In that regard, various embodiments of a mounting and clamping assembly include a contactless air-bearing assembly for stably clamping a printhead unit into an industrial inkjet thin film printing system during the mounting and clamping process. Accordingly, various embodiments of a mounting and clamping assembly of printhead unit assemblies of the present teachings provide for strain-free and repeatable positioning of a printhead unit into a printing system.

FIG. 1 is a schematic representation, which depicts some aspects of various embodiments of a self-contained printhead unit according to the present teachings. FIG. 1 depicts printhead unit I according to various embodiments; in relationship to pneumatic input, such as vacuum and inert gas; designated as external system II, as well as in relationship to fluidic output, such as local and external waste assemblies; designated as external system III. For various embodiments of self-contained printhead unit I, pneumatic manifold block assembly IA can be capable of proving fluidic distribution and control to, for example, but not limited by, between primary dispensing reservoir IC and various external sources requiring pneumatic control, such as an inert gas source IIA and a vacuum source IIB. In various embodiments of a self-contained printhead unit according to the present teachings, pneumatic manifold block assembly IA can provide control between primary dispensing reservoir IC and various pneumatic sources, for example, through valves $PMAV_1$ and $PMAV_2$. According to various embodiments of self-contained printhead unit I, fluidic manifold block assembly IB can be capable of proving fluidic distribution and control to, for example, but not limited by, primary dispensing reservoir IC, as well as bulk ink reservoir ID. In various embodiments of a self-contained printhead unit according to the present teachings, fluidic manifold block assembly IB can control the fluid communication between primary dispensing reservoir IC and printhead IE, for example, through valve $FMAV_1$. According to various embodiments of a self-contained printhead unit of the present teachings, fluidic manifold block assembly IB can control the fluid communication between primary dispensing reservoir IC and bulk ink reservoir ID, for example, through valve $FMAV_2$. For various embodiments of a self-contained printhead unit according to the present teachings, fluidic manifold block assembly IB can control the fluid communication between printhead IE and local waste reservoir IIIA for example, through valve $FMAV_3$. Various embodiments of a self-contained printhead assembly of the present teachings can have primary dispensing reservoir IC, as well as bulk ink reservoir ID each including a plurality of level indicators; such as $IL_x$, $IM_x$ and IUx. Various embodiments of a self-contained printhead unit according to the present teachings can have various level indicators for primary dispensing reservoir IC, as well as bulk ink reservoir ID be part of an automated system for maintaining a constant volume of ink in primary dispensing reservoir IC; thereby maintaining a constant pressure for ink supplied to printhead IE.

For various embodiments of a self-contained printhead unit I of FIG. 1, bulk ink supply assembly ID, can provide sufficient ink volume to keep primary dispensing reservoir assembly IC filled to a defined fill level for an entire printing process. As will be discussed in more detail subsequently, connection to pneumatic input, such as a vacuum source and a gas source, such as an inert gas source, of external system II, as well as electrical connections, can be attached to various embodiments of printhead unit I using various embodiments of an interface assembly. According to various embodiments of a printhead unit assembly of the present teachings, an interface assembly can have complementary quick-coupling features that mate with the quick-coupling features for providing electrical and pneumatic interconnections for various embodiments of printhead unit I, thereby permitting ready interchange of a plurality of self-contained printhead units of the present teachings into and out of a printing system, for example, but not limited by, during a printing process. Additionally, as will also be discussed subsequently, various embodiments of a local waste assembly, which are in fluid communication with an external waste assembly, as shown in external system III, provide for ready interchangeability of a plurality of self-contained printhead units of the present teachings into and out of a printing system during a printing process.

Figure 2:
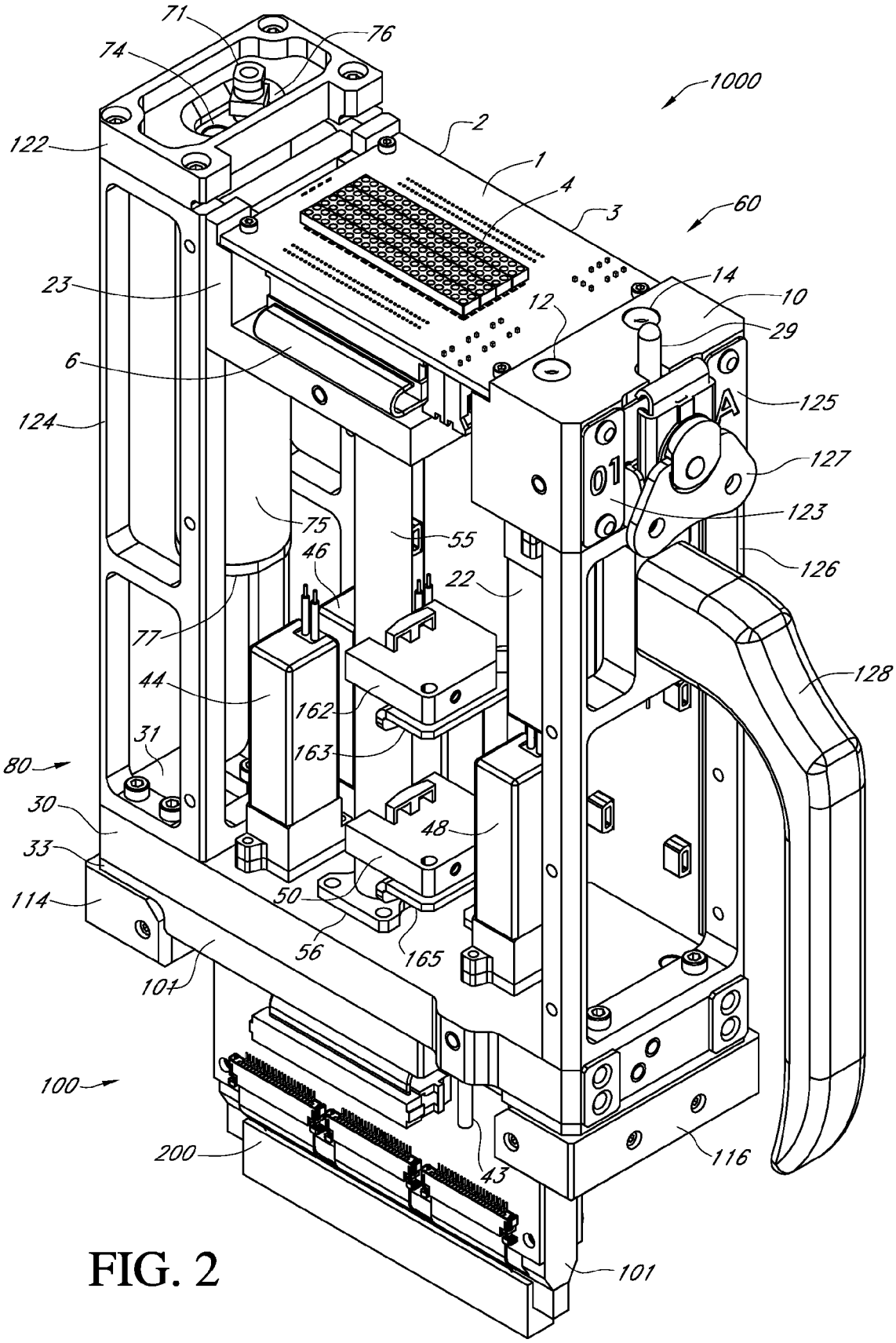
FIG. 2 is a perspective view of a printhead unit according to various embodiments of a printhead unit of the present teachings.

Various embodiments of printhead unit 1000 of FIG. 2 can have a fluidic system including pneumatic manifold block assembly 60, fluidic manifold block assembly 80 and adapter plate manifold block assembly 100.

For various embodiments of printhead unit 1000 of FIG. 2, a fluidic system can include pneumatic manifold block assembly 60. Pneumatic manifold block assembly 60 can include pneumatic manifold block 10, as well as first pneumatic manifold block valve 20, and second pneumatic manifold block valve 22. Pneumatic manifold block assembly 60 can include fluidic interconnections to a gas source, such as an inert gas source, as well as an interconnection to a vacuum source and additionally fluidic interconnections to primary dispensing reservoir assembly 50 via distribution and control provided by pneumatic manifold block 10. Pneumatic manifold block 10 can have channels fabricated therein and can be ported for communication with various manifold components, for example, but not limited by, a manifold, a valve, a reservoir, a vacuum source, and a gas source, such as an inert gas source.

Various embodiments of pneumatic manifold block 10 of FIG. 2, which has first surface 9 and second surface 11, can include pneumatic manifold block first valve 20 (not shown) and pneumatic manifold block second valve 22. As previously mentioned, pneumatic manifold block 10 can be ported for communication with various pneumatic manifold components of pneumatic manifold block assembly 60 such as, but not limited by, a manifold, a valve, a reservoir, a vacuum source, as well as a gas source, such as, but not limited by, a gas source, such as an inert gas source. Various embodiments of pneumatic manifold block 10 can have vacuum port 12 and inert gas port 14, thereby being ported for communication with a vacuum source, as well as a gas source, such as, but not limited by, an inert gas source. In various embodiments of a printhead unit 1000, O-ring seals for vacuum port 12 and inert gas port 14, in conjunction with the design of an interface assembly that can be part of a printing system, provide for quick-coupling pneumatic connections between printhead unit 1000 and a printing system. For various embodiments of a printhead unit 1000, an electrical interface board 2 can be mounted upon pneumatic manifold block 10. Electrical interface board 2 can include various types of quick-coupling electrical connections, using, for example, but not limited by, a pogo pin coupling, wherein the electrical interface board 2, can have a pogo pin pad 4 on electrical interface board first surface 1 for receiving an array of pogo pins from an interface assembly that can be part of a printing system of which printhead unit 1000 can be a component.

For various embodiments of printhead unit 1000, the quick-coupling feature provided by the electrical interface board 2, the O-ring seals of vacuum port 12 and inert gas port 14 pneumatic manifold block 10 that provide ready integration with an interface assembly, as well as a kinematic mounting and an air bearing clamping assembly of printhead unit 1000, which will be discussed in more detail subsequently, can provide for ready interchangeability of a plurality of self-contained printhead units 1000 with a printing system during a printing process. According to the present teachings, a quick coupling fitting can be any fitting designed for components that are moved regularly, and provide for ready movement of a component. As such, as one of ordinary skill in the art is apprised, any of a variety of electrical, pneumatic, and fluidic couplings can be utilized in embodiments of printhead unit 1000 and an interface assembly providing complementary connectivity in order to provide ready interchangeability of a plurality of self-contained printhead units 1000 with a printing system.

For various embodiments of printhead unit 1000 of FIG. 2, a fluidic system can include fluidic manifold block assembly 80. Fluidic manifold block assembly 80 can include fluidic manifold block 30, as well as first fluidic manifold block valve 44, second fluidic manifold block valve 46, and third fluidic manifold block valve 48. Fluidic manifold block assembly 80 can include fluidic interconnections to bulk ink reservoir assembly 70, which can be in fluid communication with primary dispensing reservoir assembly 50 via distribution and control provided by fluidic manifold block 30. Fluidic manifold block 30 can have channels fabricated therein and can be ported for communication with various manifold components, for example, but not limited by, a manifold, a valve, a reservoir and a waste assembly.

Various embodiments of fluidic manifold block 30 of FIG. 2, which has first surface 31 and second surface 33, can include first fluidic manifold block valve 44, second fluidic manifold block valve 46, and third fluidic manifold block valve 48, shown here mounted on first surface 31. As previously discussed, fluidic manifold block 1000 can be ported for communication with various manifold components such as, for example, but not limited by, valves, reservoirs, inkjet printheads, waste assemblies and manifolds. Fluidic manifold block 30 can be in fluid communication with a primary dispensing reservoir, which can include primary dispensing reservoir body 55, a primary dispensing reservoir top (not shown) and primary dispensing reservoir base 54. Various embodiments of a primary dispensing reservoir can have associated with it a first level indicator 162 and second level indicator 164, which define a maximum and minimum fill level, respectively. For various embodiments of printhead unit 1000, fluidic manifold block 30 can be in fluid communication with at least one end-user selected printhead assembly 200, which in turn can be in fluid communication with drain tube 43, which can be a part of a waste system. According to various embodiments of printhead unit 1000, drain tube 43 can be a part of a waste assembly for disposing of ink, which provides for contactless integration of a waste system with printhead unit 1000.

As depicted in FIG. 2, embodiments of bulk ink reservoir assembly 70 can include bulk ink reservoir body 75. In various embodiments, bulk ink reservoir body 75 can be covered with bulk ink reservoir top 122, which can be affixed to first support member 124. Bulk ink reservoir body 75 can be capped with a fitting (not shown) including a vent 74 and a port 76, shown fitted with a luer adapter 71. Luer adapter 71 can provide ease of filling bulk ink reservoir body 75, for example, but not limited by, using a syringe; either manually or robotically, with any of an end-user selected ink for printing on a substrate. Bulk ink reservoir base 78, can provide a bottom seal as well as a port connection to fluidic manifold block 30. According to various embodiments of a self-contained printhead unit 1000, bulk ink reservoir assembly 70 can be in fluid communication with primary dispensing reservoir assembly 50. Bulk ink reservoir assembly 70 can provide sufficient ink volume to keep primary dispensing reservoir assembly 50 filled to a defined fill level for an entire printing process. Such continual replenishment resulting in a constant volume in a primary dispensing reservoir thereby maintains a constant head pressure over a printhead. During such a printing process, a plurality of readily interchangeable, self-contained printhead units 1000 can be used. Having a two-stage reservoir system in various embodiments of printhead unit 1000 can assist in providing for ready interchangeability of a plurality of printhead units 1000 by eliminating a tubing connection to an ink supply external printhead unit 1000. Moreover, providing self-contained ink supply for a plurality of interchangeable printhead units 1000 prevents cross-contamination of various end-user selected inks contained in a plurality of self-contained printhead units 1000. According to various embodiments of printhead unit 1000, a quick-coupling tubing connection can provide ready interchangeability of a printhead unit 1000 with an ink supply external printhead unit 1000.

For various embodiments of printhead unit 1000 of FIG. 2, a fluidic system can include adapter plate manifold block assembly 100. Adapter plate manifold block assembly 100 can provide for fluid communication between fluidic manifold block 30 and printhead 205 of printhead assembly 200, as well as providing a mounting surface to mount an end-user selected printhead assembly, such as printhead assembly 200, to various embodiments of a printhead unit of the present teachings. According to various embodiments of printhead unit 1000, adapter manifold assembly 100 can have a adapter manifold assembly first member 115 that can provide structural connectivity as well as fluid commutation between fluidic manifold block 30 and adapter plate manifold block assembly 100. According to various embodiments of printhead unit 1000, adapter manifold assembly 100 can have adapter manifold assembly second member 117 that can provide structural connectivity as well as fluid commutation between adapter plate manifold block assembly 100 and printhead assembly 200.

In various embodiments of printhead unit 1000, adapter manifold assembly first member 115 can provide a mounting surface for first guide 114 and second guide 116 as well as providing a mounting surface for a set of stainless steel balls (not shown). First guide 114 and second guide 116 can be affixed to adapter manifold assembly first member 115 to act as guides during the positioning of printhead unit 1000 into a kinematic mount assembly. As will be discussed in more detail subsequently, a set of stainless steel balls mounted on first adapter manifold assembly member second surface 92, are part of the kinematic mounting assembly. As previously discussed, for various embodiments of self-contained printhead unit 1000, the electrical and pneumatic quick-coupling components, as well as the kinematic mounting components are some of the components that provide for the ready interchangeability of a plurality of printhead units 1000 during a printing process.

Figure 3A:
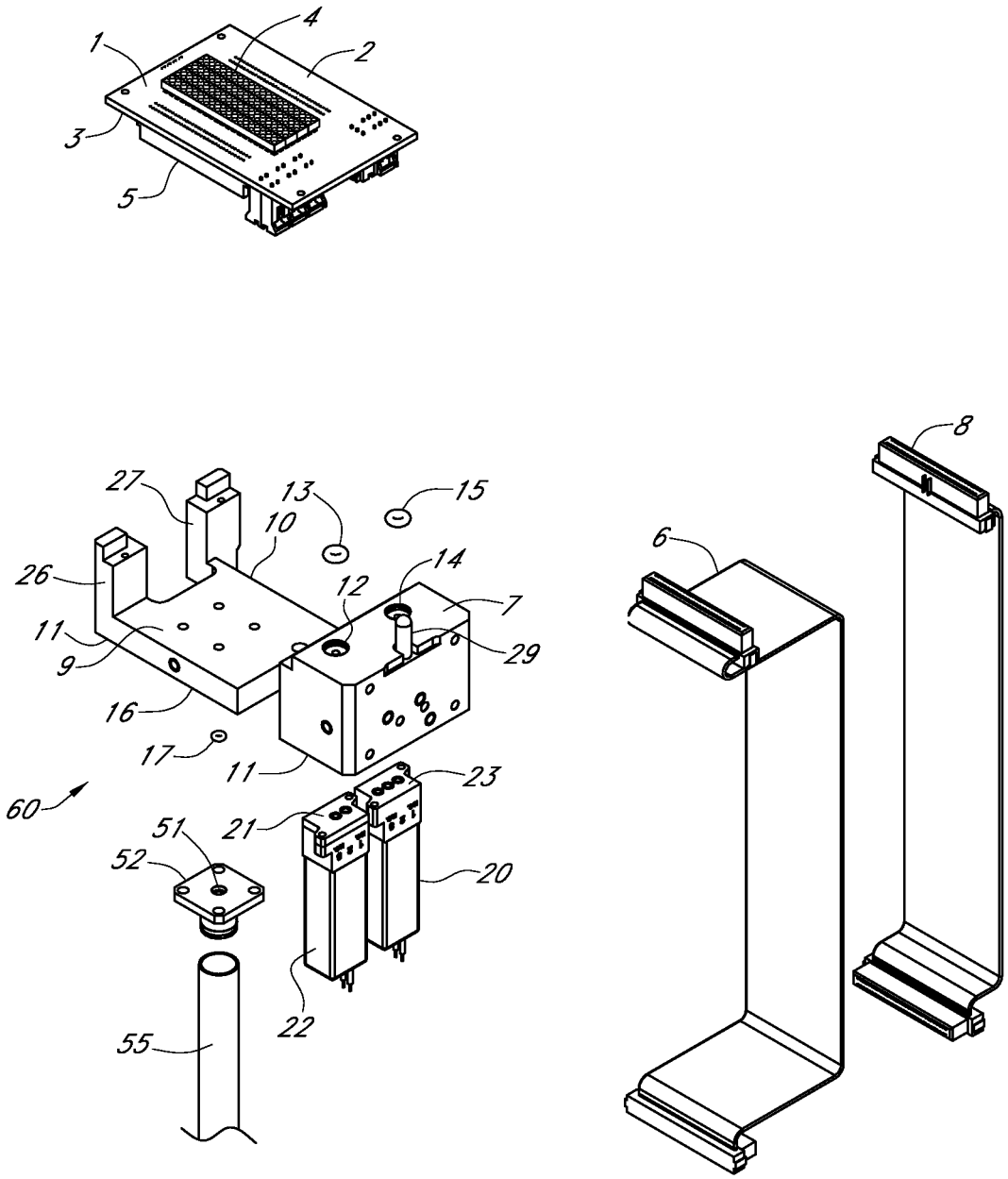
FIG. 3A-FIG. 3C are exploded views a printhead unit according to various embodiments of a printhead unit of the present teachings.
Figure 3B:
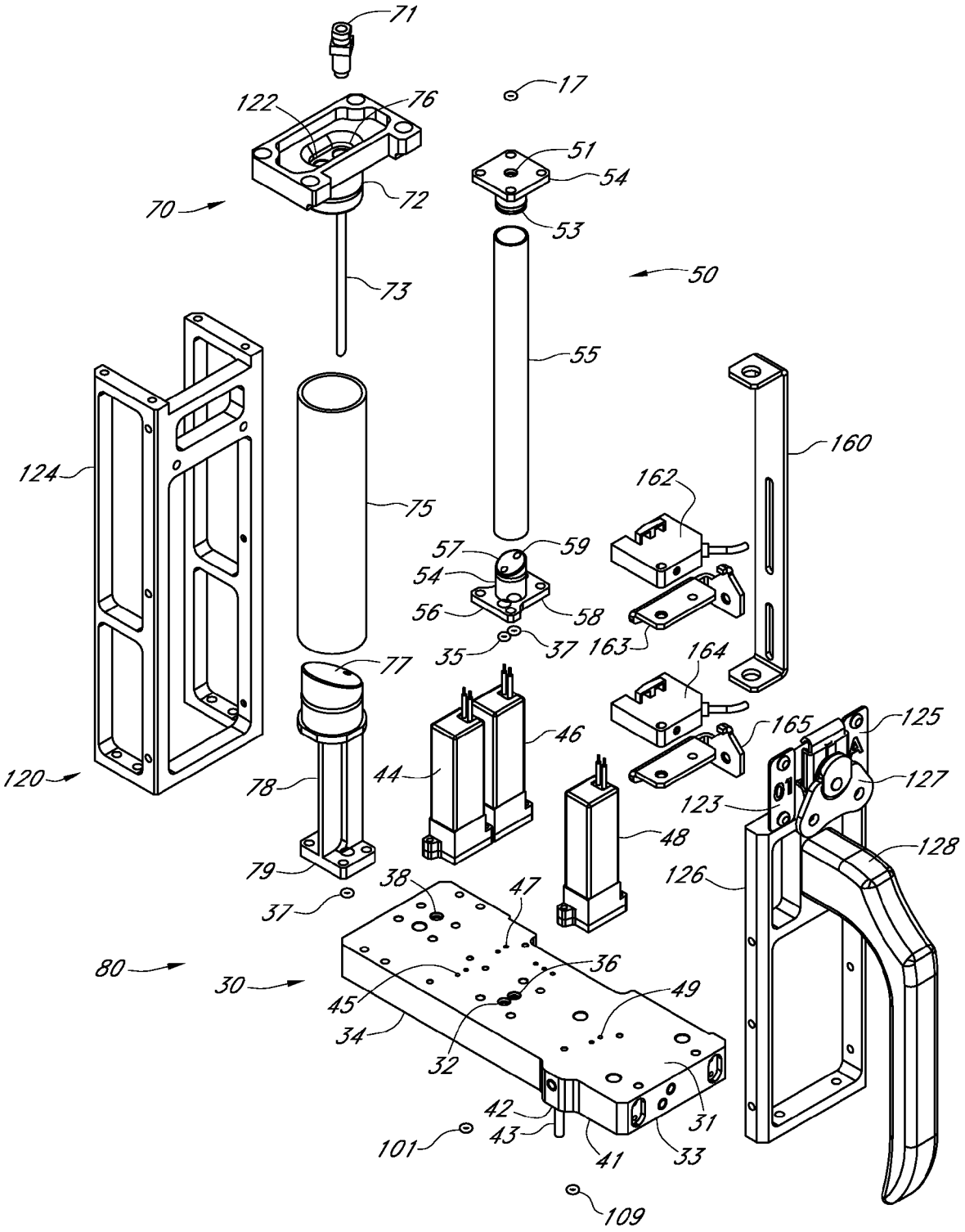
Figure 3C:
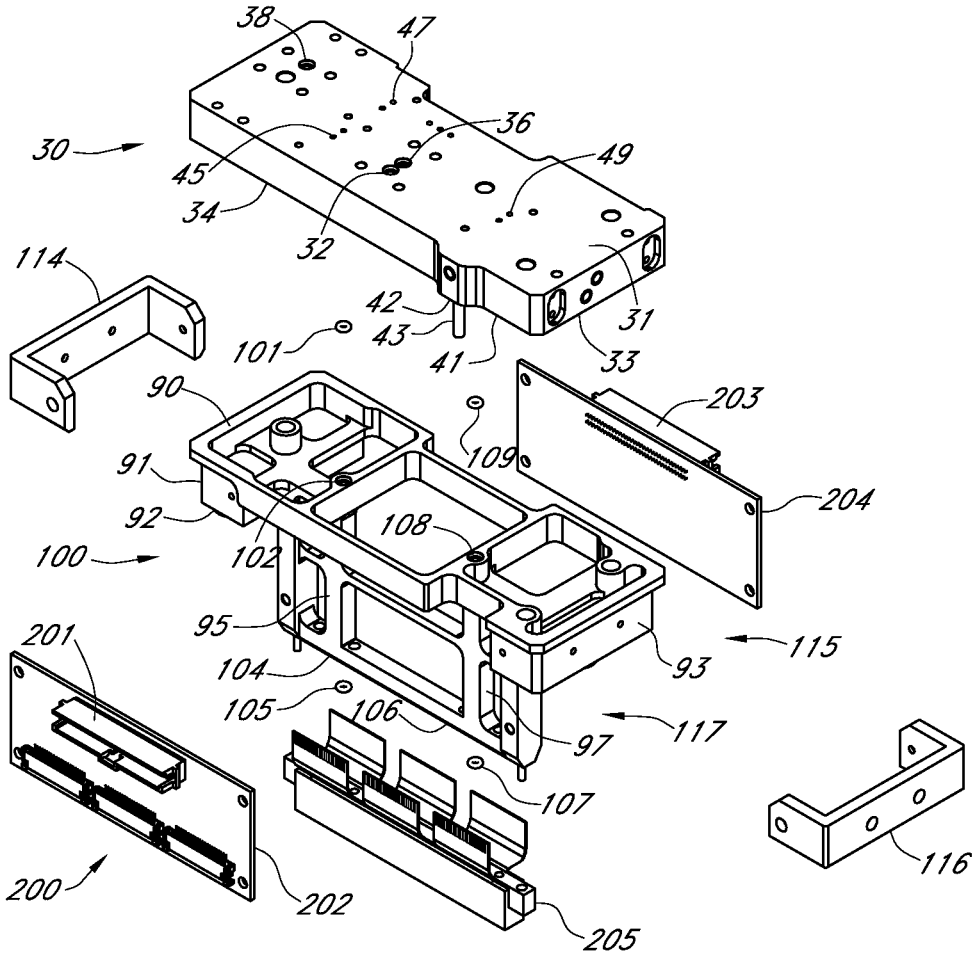

More detailed views of various embodiments of printhead unit 1000 are given in FIG. 3A-FIG. 3C, which show upper, mid and lower exploded views of printhead unit 1000.

FIG. 3A depicts an exploded view of an upper portion of printhead unit 1000, which can include pneumatic manifold block assembly 60, according to various embodiments. Electrical interface board 2 has a pogo pin pad 4 on first surface 1 for receiving a pogo pin array. As previously mentioned a pogo pin connection can be an electrical quick-coupling connection, which along with butt-coupled mated ports utilizing O-ring connections as pneumatic quick-coupling connections, are elements in providing ready interchangeability of a plurality of printhead units 1000. Additionally, first ribbon cable connection 5 on second surface 3 of electrical interface board 2 can be for connection of first ribbon cable 6, which connects to printhead assembly first PCB interconnect 201, shown in FIG. 3C. Likewise second ribbon cable connection 7 (not shown) on second surface 3 of electrical interface board 2 can be for connection of second ribbon cable 8, which connects to printhead assembly second PCB interconnect 203, as shown in FIG. 3C.

Various embodiments of pneumatic manifold block 10 can provide printhead unit 1000 as shown in the top exploded view of FIG. 3A with interconnection and control to, for example, but not limited by, a vacuum source as well as a gas source, such as, but not limited by, a gas source, such as an inert gas source. As one of ordinary skill in the art of inkjet printing can be apprised, a partial vacuum can be typically applied over an ink reservoir in order to offset the pressure in the ink supplied to a printhead created by the position of a reservoir over a printhead. In various embodiments of a printhead unit 1000, first pneumatic manifold block valve 20 of pneumatic manifold block 10, can control both the fluid distribution and control between a gas source, such as an inert gas source and primary dispensing reservoir assembly 50 of FIG. 2 as well as the fluid distribution and control between second pneumatic manifold valve 22 and primary dispensing reservoir assembly 50 of FIG. 2. Additionally, second pneumatic manifold block valve 22 of pneumatic manifold block 10 can control the communication between first pneumatic manifold block valve 20 and a vacuum source. Various embodiments of pneumatic manifold block 10 as shown in FIG. 3A can be ported for communication on second surface 11 with primary dispensing reservoir assembly 50. As depicted in FIG. 3A, pneumatic manifold block third port 16 can be in fluid communication with primary dispensing reservoir assembly 50 via primary dispensing reservoir top 52 having first port 51, where pneumatic manifold block third port 16 and primary dispensing reservoir first port 51 are sealed using O-ring 17. Pneumatic manifold block 10, according to various embodiments as depicted in FIG. 3A, can have first and second electrical connection board support posts, 25 and 27, respectively, for mounting electrical interface board 2. According to various embodiments of printhead unit 1000, guide pin 29 facilitates attachment of printhead unit 1000 with an interface assembly, which will be discussed in more detail subsequently. In various embodiments of pneumatic manifold block 10, valves, such as valves 20, and 22 can be for example, but not limited by, a solenoid valve. For various embodiments of pneumatic manifold block 10, valves 20 and 22 can be integrated onto the manifold block without tubing connections. In various embodiments of pneumatic manifold block 10, valves 20 and 22 can be integrated onto the manifold block using tubing connections.

FIG. 3B depicts an exploded view of the mid portion of printhead unit 1000, which can include fluidic manifold block assembly 80, according to various embodiments of a printhead unit assembly. Fluidic manifold block assembly 80 can include fluidic manifold block 30, which can be ported for fluid distribution and control with various fluidic manifold components, such as, but not limited by, primary dispensing reservoir assembly 50, bulk ink reservoir assembly 70, printhead assembly 200 (FIG. 2) and a waste assembly, of which drain tube 43 can be a component. Various embodiments of fluidic manifold block 30 can have fluidic manifold block first port 32 on first surface 31, and fluidic manifold block second port 34 on second surface 33, which provide for fluid communication between primary dispensing reservoir assembly 50 and printhead assembly 200 (FIG. 2). In order to control the fluid communication between primary dispensing reservoir assembly 50 and printhead assembly 200, various embodiments of fluidic manifold block 30 can be ported to provide valve control by valve 44, as depicted by ports 45. Various embodiments of fluidic manifold block 30 can have fluidic manifold block third port 36 on first surface 31 and forth port 38 on first surface 31, which provide for fluid communication between primary dispensing reservoir assembly 50 and bulk ink reservoir assembly 70. In order to control the fluid communication between primary dispensing reservoir assembly 50 and bulk ink reservoir assembly 70, various embodiments of fluidic manifold block 30 can be ported to provide valve control using valve 46, as depicted by ports 47. Various embodiments of fluidic manifold block 30 can have fluidic manifold block fifth port 41 on second surface 33, which provides for fluid communication between printhead assembly 200 (FIG. 2) and primary dispensing reservoir assembly 50 for ink return, which fluidic manifold block fifth port 41 can be in fluid communication with fluidic manifold block sixth port 42 on second surface 33 of fluidic manifold block 30. Fluidic manifold block sixth port 42 can be in fluid communication with a waste assembly, of which drain tube 43 can be a part, which will be discussed in more detail subsequently. In order to control the fluid communication between printhead assembly 200 (FIG. 2) and primary dispensing reservoir assembly 50 for ink return to a waste assembly, various embodiments of fluidic manifold block 30 can be ported to provide valve control using valve 48 as depicted by ports 49. In various embodiments of fluidic manifold block 30, valves, such as valves 44, 46, and 48 can be for example, but not limited by, a solenoid valve. For various embodiments of fluidic manifold block 30, valves 44, 46, and 48 can be integrated onto the manifold block without tubing connections. In various embodiments of embodiments of fluidic manifold block 30, valves 44, 46, and 48 can be integrated onto the manifold block using tubing connections.

In various embodiments of printhead unit 1000 as depicted in FIG. 3B, can have fluidic manifold block 30, which can include primary dispensing reservoir assembly 50 mounted thereupon. Primary dispensing reservoir assembly 50 can include primary dispensing reservoir body 55, which can be sealed at one end by primary dispensing reservoir top 52 and on another end by primary dispensing reservoir base 54. Primary dispensing reservoir top 52 can have primary dispensing reservoir top second port 53 which can be in communication with primary dispensing reservoir first port 51, which as was previously mentioned can be in communication with pneumatic manifold block 10 (FIG. 3A). In various embodiments of primary dispensing reservoir assembly 50, primary dispensing reservoir base first port 57 can be in fluid communication with primary dispensing reservoir base second port 56. As depicted in FIG. 3B, O-ring 35 forms a seal between primary dispensing reservoir base second port 56 and fluidic manifold block first port 32. Various embodiments of primary dispensing reservoir assembly 50 can have primary dispensing reservoir base third port 59, which can be in fluid communication with primary dispensing reservoir base forth port 58. As depicted in FIG. 3B, O-ring 37 forms a seal between primary dispensing reservoir base forth port 58 and fluidic manifold block third port 36.

As previously discussed, fluidic manifold block 30 can be ported to provide fluid distribution and control between primary dispensing reservoir assembly 50 and bulk ink reservoir assembly 70, which can have bulk ink reservoir assembly top fitting 72. Bulk ink reservoir assembly top fitting 72 can include vent 74, port 76 and dip tube 73, which can be in fluid communication with port 76. Luer adapter 71, fitted into port 76, and dip tube 73 provide for ease of filling bulk ink reservoir assembly 70 with any of an end-user selected ink for printing on a substrate. Bulk ink reservoir assembly can have base 78, which includes bulk ink reservoir base first port 77 and bulk ink reservoir base second port 79. As depicted in FIG. 3B, O-ring 37 forms a seal between bulk ink reservoir base second port 79 and fluidic manifold block fourth port 38. As previously discussed, bulk ink reservoir assembly 70 can provide sufficient ink volume to keep primary dispensing reservoir assembly 50 filled to a defined fill level for an entire printing process.

As depicted in FIG. 3B, various embodiments of printhead unit 1000 can have various embodiments of support structure assembly 120. Support structure assembly 120 can include first support member top 122, which can be affixed to first support member 124, and can cover bulk ink reservoir assembly 70. Various embodiments of support structure assembly 120 can additionally include second support member 126 that can be mounted between the pneumatic manifold block 10 and the fluidic manifold block 30. Support structure assembly handle 128 can be attached to second support member 126, and provides for either manual or robotic manipulation of printhead unit 1000. Draw latch 127 can be a part of an attachment structure for attaching printhead unit 1000 with an interface assembly.

Additionally, level indicator assembly 160 for primary dispensing reservoir assembly 50 can include first level indicator bracket 163 and second level indicator bracket 165, which can be affixed to bracket mount 161. Bracket mount 161 can be mounted between pneumatic manifold block 10 (FIG. 2) and fluidic manifold block 30. For various embodiments of printhead unit 1000 for primary dispensing reservoir assembly 50, first level indicator bracket 163 can support first level indicator 162, which can be used to determine an upper fill level. Second level indicator bracket 165 can support second level indicator 164, which can be used to indicate a minimum fill level. In various embodiments of a printhead unit of the present teachings, the function of a level indicator for primary dispensing reservoir assembly 50 can be to provide for continual replenishment of fluid via automated sensing and control in order to provide a constant fluid level for in primary dispensing reservoir assembly 50. Control of the fluid level in primary dispensing reservoir assembly 50 provides for control of the pressure of ink supplied to a printhead that can be in fluid communication with primary dispensing reservoir assembly 50.

For various embodiments of printhead unit 1000 of FIG. 3B, first printhead unit identification plate 123 and second printhead unit identification plate 125 for various embodiments can be mounted on pneumatic manifold block 10, as shown in FIG. 2, or for various embodiments, on second support member 124 as depicted in FIG. 3B. First printhead unit identification plate 123 and second printhead unit identification plate 125 case can be mounted anywhere on printhead unit 1000 where the identification plates are be visible to an end-user, or where they are readable by a machine or robot adapted to read them. As previously mentioned, various embodiments of printhead unit 1000 have an identification or recognition code that can be indicated physically on a printhead unit, as well as electronically associated with each printhead unit. For various embodiments of a printhead unit, the identification or recognition code can associate each unit with a unique set of operational information for each printhead unit. For example, but not limited by, the unique operational information can include a unique location in a maintenance module while it is not engaged in a printing system, the ink formulation contained in the printhead unit, and printhead calibration data. Such unique operational information can be stored on a memory device. For various embodiments, the memory device can be an on-board memory device that travels with each printhead unit. In various embodiments, first printhead unit identification plate 123 can have an identification selected from alpha, numeric, and alphanumeric characters associating printhead unit 1000 with, for example, but not limited by, ink type and calibration data. For various embodiments second printhead unit identification plate 125 can have an identification selected from alpha, numeric, and alphanumeric characters associating printhead unit 1000 with, for example, but not limited by, a position in a maintenance or capping station. In a variety of embodiments, the identification or recognition code comprises one or more machine-readable codes such as one or more identification or recognition codes embodied in one or more bar codes or one or more radiofrequency identification, or RFID, tags.

FIG. 3C depicts an exploded view of the lower portion of printhead unit 1000, according to various embodiments. Adapter plate manifold block assembly 100 provides for fluid communication between fluidic manifold block 30 and printhead 205 of printhead assembly 200, as well as providing a mounting surface to mount an end-user selected printhead assembly, such as printhead assembly 200, to various embodiments of a printhead unit of the present teachings. According to various embodiments of printhead unit 1000, adapter manifold assembly 100 can have a adapter manifold assembly first member 115 that can provide structural connectivity as well as fluid commutation between fluidic manifold block 30 and adapter plate manifold block assembly 100. According to various embodiments of printhead unit 1000, adapter manifold assembly 100 can have a adapter manifold assembly second member 117 that can provide structural connectivity as well as fluid commutation between adapter plate manifold block assembly 100 and printhead assembly 200.

Various embodiments of adapter manifold assembly first member 115 of FIG. 3C can have an first adapter manifold assembly member first surface 90, which provides a mounting surface for mounting fluidic manifold block 30, as well as being ported to provide fluidic communication between fluidic manifold block 30 and first adapter manifold assembly member first surface 90. Various embodiments of adapter manifold assembly first member 115 of FIG. 3C can have first adapter manifold assembly member second surface 92, from which adapter manifold assembly second member 117 can be pendant. Various embodiments of adapter manifold assembly second member 117 can include first mounting surface 94, second mounting surface 96 and bottom surface 98, as well as first channel member 95, having a first channel fabricated therethrough and second channel member 97, having a second channel fabricated therethrough.

For various embodiments of adapter plate manifold block assembly 100, first adapter manifold assembly member first surface 90 can have adapter plate manifold block assembly first port 102 and adapter plate manifold block assembly second port 104, which is on bottom surface 98 of adapter manifold assembly second member 117. Adapter plate manifold block assembly first port 102 can be in fluid communication with adapter plate manifold block assembly second port 104 through a first channel in first channel member 95. Adapter plate manifold block assembly second port 104 can be in fluid communication with an printhead inlet port (not shown) of printhead 205, which can be in fluid communication with an printhead outlet port (not shown) printhead 205. As depicted in FIG. 3C, O-ring 101 can form a seal between adapter plate manifold block assembly first port 102 and fluidic manifold block second port 34, while O-ring 105 can form a seal between adapter plate manifold block assembly second port 104 and an printhead inlet port (not shown) of printhead 205. In various embodiments of adapter plate manifold block assembly 100, an printhead outlet port (not shown) of printhead 205 can be in fluid communication with adapter plate manifold block assembly third port 106, which is on bottom surface 98 of adapter manifold assembly second member 117. According to various embodiments of adapter plate manifold block assembly 100, adapter plate manifold block assembly third port 106 can be in fluid communication with adapter plate manifold block assembly forth port 108, through a second channel in second channel member 97. Adapter plate manifold block assembly forth port 108 can be in fluid communication with fluidic manifold block fifth port 41. As depicted in FIG. 3C, O-ring 107 can form a seal between adapter plate manifold block assembly third port 106 and printhead outlet port (not shown) of printhead 205, while O-ring 109 can form a seal between adapter plate manifold block assembly forth port 108 and fluidic manifold block fifth port 41.

Figure 4A:
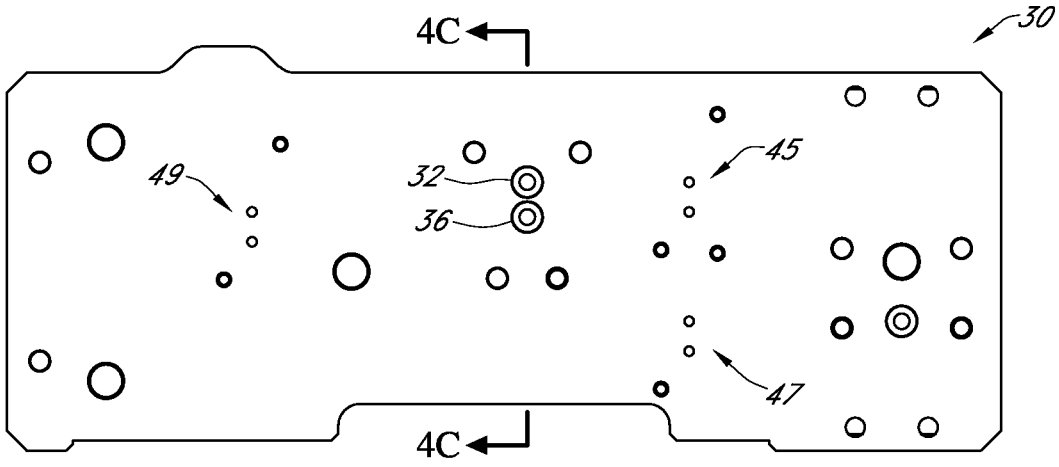
FIG. 4A-FIG. 4D depict various views of a fluidic manifold block according to various embodiments of a printhead unit of the present teachings.
Figure 4B:
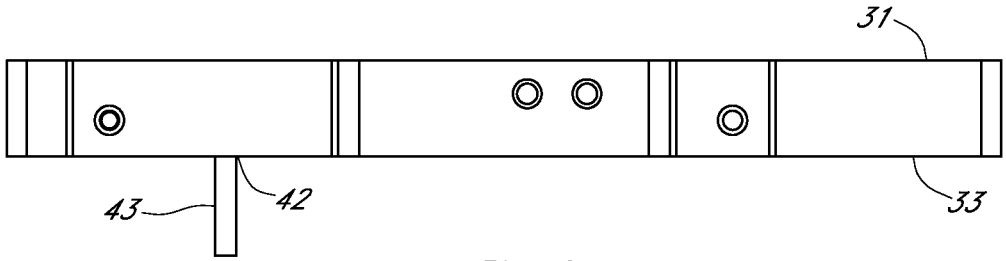
Figure 4C:
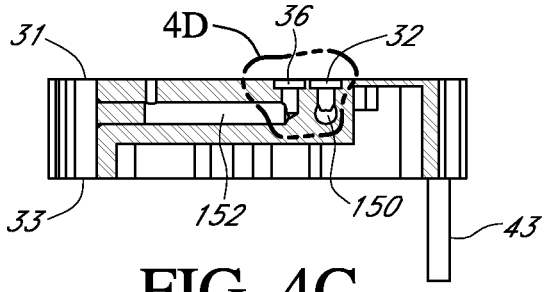
Figure 4D:
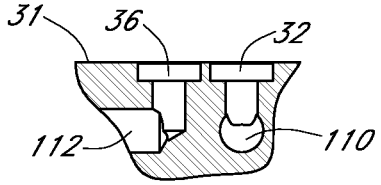

As has been previously discussed in reference to FIG. 3A-FIG. 3C, various manifold assembly components, such as pneumatic components, for example, but not limited by, a vacuum source or a gas source, such as inert gas source, reservoirs, valves, printheads, waste assemblies, another manifold, and the like, can be coupled to a manifold block through complementary ports sealed with an O-ring seal. FIG. 4A shows fluidic manifold block first port 32 and third port 36 as exemplary. FIG. 4B depicts a side view of fluidic manifold block 30 according to various embodiments, which indicates fluidic manifold block sixth port 42, from which drain tube 43 can be affixed and sealed using an O-ring seal. FIG. 4C show a cross-sectional view, as indicated in FIG. 4A, and depicts fluidic manifold block first port 32 in fluid communication with fluidic manifold block first channel 110, as well as fluidic manifold block third port 36 in fluid communication with fluidic manifold block third channel 112. As shown in FIG. 4C and especially as shown in FIG. 4D, the ports on each of a manifold component, as well as the ports on each of the pneumatic and fluidic manifold blocks, have been machined to accept an O-ring, which as one of ordinary skill in the art can understand, provides a tight seal to prevent fluid leakage thereby.

Figure 5:
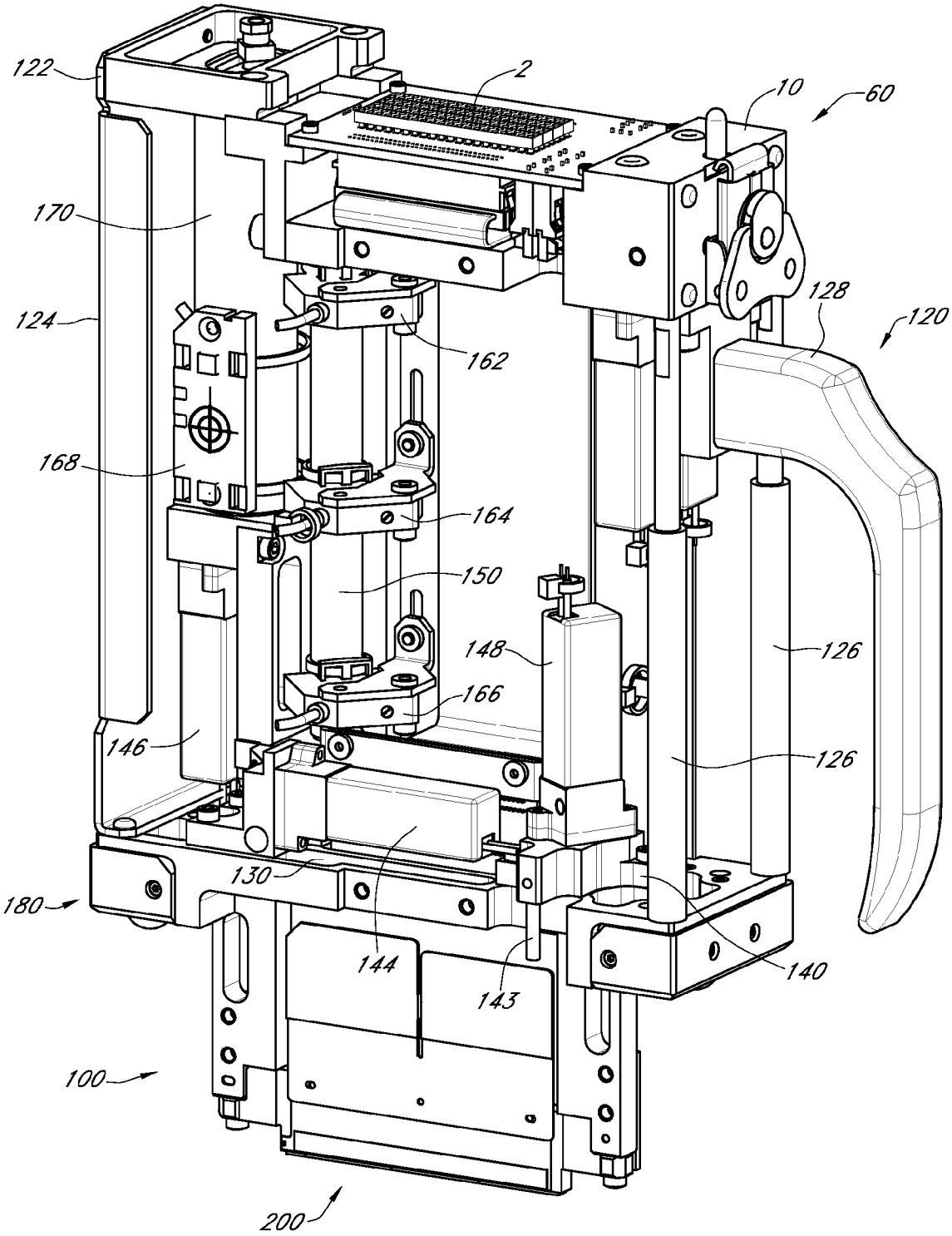
FIG. 5 is a perspective view of a printhead unit according to various embodiments of a printhead unit of the present teachings.

Various embodiments of self-contained printhead unit 1100 of FIG. 5 can have features similar to those described for various embodiments of printhead unit 1000 of FIG. 2. For example, but not limited by, various embodiments of printhead unit 1100 of FIG. 5 can have a fluidic system including pneumatic manifold block assembly 60, modular fluidic manifold block assembly 180 and adapter plate manifold block assembly 100.

Various embodiments of self-contained printhead unit 1100 of FIG. 5 can have Pneumatic manifold block assembly 60 that can include pneumatic manifold block 10, upon which electrical interface board 2 can be mounted. As previously described for printhead unit 1000 of FIG. 2, pneumatic manifold block 10 can have channels fabricated therein and can be ported for communication with various manifold components, for example, but not limited by, a manifold, a valve, a reservoir, a vacuum source, and a gas source, such as an inert gas source. Electrical interface board 2 can include various types of quick-coupling electrical connections, using, for example, but not limited by, a pogo pin coupling. As previously described for printhead unit 1000 of FIG. 2, the quick-coupling feature provided by the electrical interface board 2, as well as pneumatic interface features of pneumatic manifold block 10, are some of the components of various embodiments of a printhead unit of the present teachings that provide ready integration various embodiments of a printhead unit with an interface assembly.

As depicted in FIG. 5, various embodiments of printhead unit 1100 can have bulk ink reservoir assembly 170 that can be in fluid communication with primary dispensing reservoir assembly 150. Bulk ink reservoir assembly 170 can have a volume sufficient to provide a continuous supply of ink to a primary dispensing reservoir 150 over the course of a printing process. For various embodiments of printhead unit 1100 of FIG. 5, the continuous supply of ink to primary dispensing reservoir assembly 150 can maintain a constant volume in a primary dispensing reservoir, which during printing can be in fluid communication with printhead assembly 200. In that regard, various embodiments of a printhead unit include at least one liquid level indicator for maintaining a defined fill level for the primary dispensing reservoir. As depicted in FIG. 5, level indicator assembly 160 for primary dispensing reservoir assembly 150 and bulk ink reservoir assembly 170 can include upper primary dispensing reservoir assembly level indicator 162, middle primary dispensing reservoir assembly level indicator 164, lower primary dispensing reservoir assembly level indicator 166, and bulk ink reservoir level indicator 168. Regarding level indicator assembly 160 for primary dispensing reservoir assembly 150, first level primary dispensing reservoir assembly indicator 162 can be used to determine an upper fill level, middle primary dispensing reservoir assembly level indicator 164 can be used to indicate a target fill level, while lower primary dispensing reservoir assembly level indicator 166 can be used to determine an lower fill level. Regarding level indicator assembly 160 for bulk ink reservoir assembly 170, bulk ink reservoir level indicator 168 can be used to indicate a target fill level for bulk ink reservoir assembly 170. In various embodiments of a printhead unit of the present teachings, the function of level indicator assembly 160 for primary dispensing reservoir assembly 150 can be to provide for automated sensing and control to provide continual replenishment of fluid in both primary dispensing reservoir assembly 150 and bulk ink reservoir assembly 170.

As depicted in FIG. 5, various embodiments of printhead unit 1100 can have various embodiments of support structure assembly 120. Support structure assembly 120 can include first support member top 122, which can be affixed to first support member 124, and can cover bulk ink reservoir assembly 170. Various embodiments of support structure assembly 120 can additionally include second support member 126, which for printhead unit 1100 can be a set of posts that can be mounted between the pneumatic manifold block assembly 60 and adapter plate manifold block assembly 100. Support structure assembly handle 128 can be attached to pneumatic manifold block 10, and provides for either manual or robotic manipulation of printhead unit 1100. Draw latch 127 can be a part of an attachment structure for attaching printhead unit 1000 with an interface assembly. Additionally, various embodiments of printhead unit 1100 can have first printhead unit identification plate 123 and second printhead unit identification plate 125, as previously discussed for various embodiments of printhead unit 1000 of FIG. 2.

Various embodiments of self-contained printhead unit 1100 of FIG. 5 can have modular fluidic manifold block assembly 180, which can include fluidic interconnections to bulk ink reservoir assembly 170. Bulk ink reservoir assembly 170 can be in fluid communication with primary dispensing reservoir assembly 150 via distribution and control provided by fluidic manifold block 130. For various embodiments of printhead unit 1100, first fluidic manifold block 130 can be in fluid communication with at least one end-user selected printhead assembly 200 via adapter plate manifold block assembly 100. In that regard, first fluidic manifold block 130 of printhead unit 1100 can provide a constant ink supply to printhead assembly 200. Regarding a waste return, printhead assembly 200 can be fluid communication with adapter plate manifold block assembly 100, which can be in fluid communication with second fluidic manifold block 140. Fluidic manifold block 140 can include drain tube 143. According to various embodiments of printhead unit 1100, drain tube 143 of fluidic manifold block 140 can be a part of a waste assembly for disposing of ink, which provides for contactless integration of a waste system with printhead unit 1100.

As such, various embodiments of printhead unit 1100 of FIG. 5 through FIG. 10 can utilize a modular fluidic manifold block assembly comprising, for example, but not limited by, first fluidic manifold block 130 and second fluidic manifold block 140 of modular fluidic manifold block assembly 180, which provide the equivalent distribution and control provided by fluidic manifold block 30 of by fluidic manifold block assembly 80, as previously described.

Figure 6:
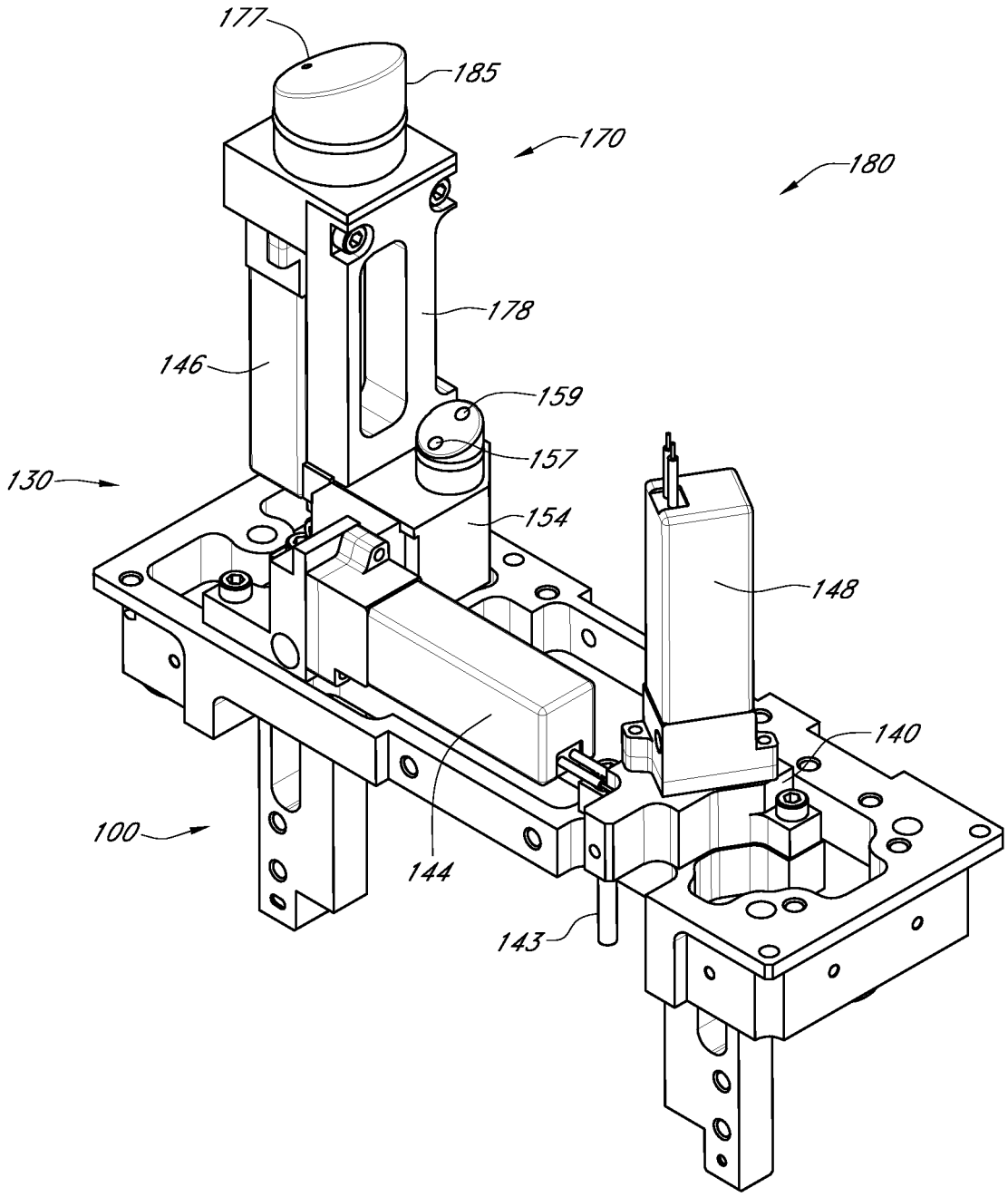
FIG. 6 is a perspective view of various manifold assemblies of a printhead unit in accordance with the present teachings.

FIG. 6 depicts a partial perspective view of various embodiments of modular fluidic manifold block assembly 180 mounted upon adapter plate manifold block assembly 100. First fluidic manifold block 130 can have primary dispensing reservoir base 154 for mounting various embodiments of a primary dispensing reservoir assembly (see FIG. 3B). Primary dispensing reservoir base 154 can have primary dispensing reservoir base first port 157 and primary dispensing reservoir base third port 159. Primary dispensing reservoir base first port 157 can be in fluid communication with first fluidic manifold block valve 144, while primary dispensing reservoir base third port 159 can be in fluid communication with second fluidic manifold block valve 146. Bulk ink reservoir assembly can have bulk reservoir assembly base channel member 178, which can be in fluid communication primary dispensing reservoir base 154 and bulk ink reservoir base 185. Bulk ink reservoir base 185 can have bulk ink reservoir base first port 177. Additionally, bulk ink reservoir base 185 can be used for mounting various embodiments of a bulk reservoir assembly (see FIG. 3B). Second fluidic manifold block valve 146 can be mounted to a lower side of bulk ink reservoir base 185. Second fluidic manifold block 140 can have third fluidic manifold block valve 148, as well as drain tube 143.

Figure 7:
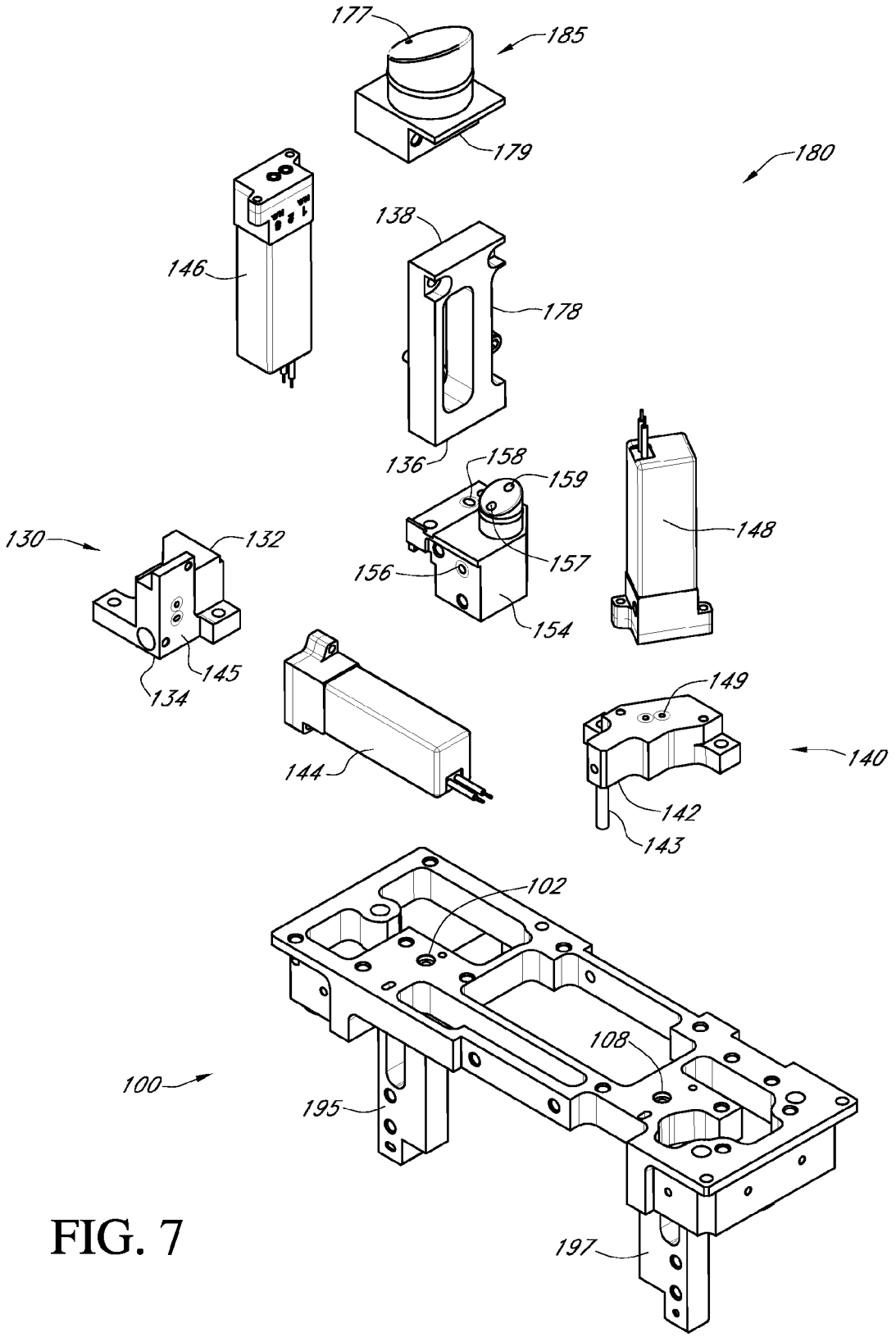
FIG. 7 is an exploded perspective view of various manifold assemblies in accordance with various embodiments of a printhead unit of the present teachings.

FIG. 7 depicts an exploded view of the partial perspective view of various embodiments of modular fluidic manifold block assembly 180 of FIG. 6. As previously discussed, primary dispensing reservoir base 154 mounting various embodiments of a primary dispensing reservoir assembly (see FIG. 3B). First fluidic manifold block 130 of modular fluidic manifold block assembly 180 can have primary dispensing reservoir base 154 can have primary dispensing reservoir base first port 157 and primary dispensing reservoir base third port 159. As depicted FIG. 7, for various embodiments of first fluidic manifold block 130 of modular fluidic manifold block assembly 180, primary dispensing reservoir base first port 157 and primary dispensing reservoir base third port 159 can be in fluid communication with primary dispensing reservoir base second port 156 and primary dispensing reservoir base forth port 158, respectively. Primary dispensing reservoir base second port 156 can be in fluid communication with first fluidic manifold block valve 144 via fluidic manifold block assembly first port 132 in first fluidic manifold block valve manifold 145. Fluidic manifold block assembly first port 132 in first fluidic manifold block valve manifold 145 can be in fluid communication with fluidic manifold block assembly second port 134. Fluidic manifold block assembly second port 134 can be in fluid communication with a printhead via adapter plate manifold assembly 100. Primary dispensing reservoir base forth port 158 can be in fluid communication with bulk reservoir assembly base channel member 178 via fluidic manifold block assembly third port 136 in bulk reservoir assembly base channel member 178. Fluidic manifold block assembly third port 136 can be in fluid communication with fluidic manifold block assembly forth port 138, which are both in bulk reservoir assembly base channel member 178. In that regard, bulk ink reservoir assembly base channel member 178 can be in fluid communication primary dispensing reservoir base 154 and bulk ink reservoir base 185. Bulk ink reservoir base 185, shown with bulk ink reservoir base first port 177, can be used for mounting various embodiments of a bulk reservoir assembly (see FIG. 3B). Second fluidic manifold block valve 146, for controlling the fluid communication between a primary dispensing reservoir and a bulk ink reservoir can be mounted to a lower side of bulk ink reservoir base 185. Second fluidic manifold block 140 of modular fluidic manifold block assembly 180 can have third fluidic manifold block valve 148, which can be mounted on second fluidic manifold block valve manifold 149, and in fluid communication with fluidic manifold block assembly fifth port 141. Drain tube 143 can be inserted into fluidic manifold block assembly sixth port 142 can be in fluid communication with a waste assembly.

Accordingly, as depicted in FIG. 7, various embodiments of a modular manifold block assembly 180, which can have, for example, but not limited by first fluidic manifold block 130 and second fluidic manifold block 140, which provide the equivalent distribution and control provided by fluidic manifold block 30 of by fluidic manifold block assembly 80, as previously described.

Figure 8B:
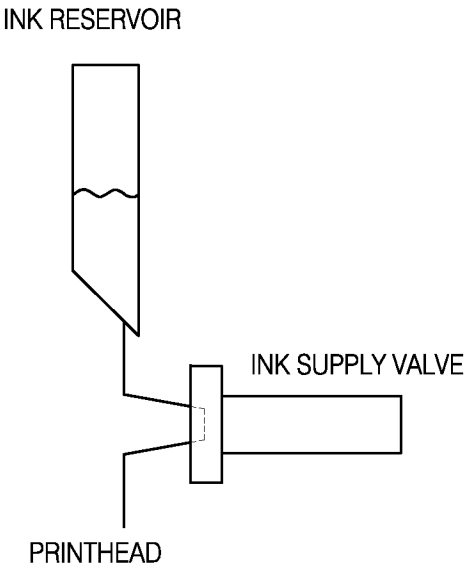
FIGS. 8A and 8B are schematic views of a fluidic design for preventing bubbles from being trapped in ink delivery lines, in accordance with various embodiments of a printhead unit of the present teachings.
Figure 8A:
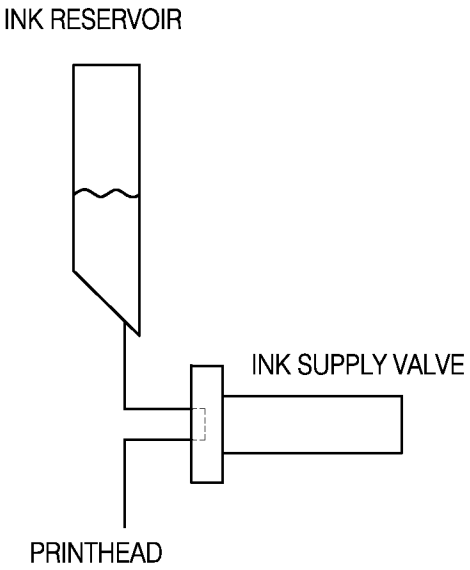

FIG. 8A and FIG. 8B depict various desired orientations of an ink supply valve controlling the fluid communication between a primary dispensing reservoir and a printhead, such as first fluidic manifold block valve 144 of first fluidic manifold block 130 shown in FIG. 5. Various embodiments of a fluidic manifold block, where the orientation of a fluidic manifold block valve can be positioned as shown in FIG. 8A and FIG. 8B, can provide for controlling the flow of fluids in a channel so that no high points exist in a valve assembly, where bubbles can be trapped. In that regard, various embodiments of a fluidic manifold block, where the orientation of a fluidic manifold block valve can be positioned as shown in FIG. 8A and FIG. 8B, can be used for example, but not limited by, when printing with various ink formulations that may be more apt to promote bubble formation in a channel.

Figure 9:
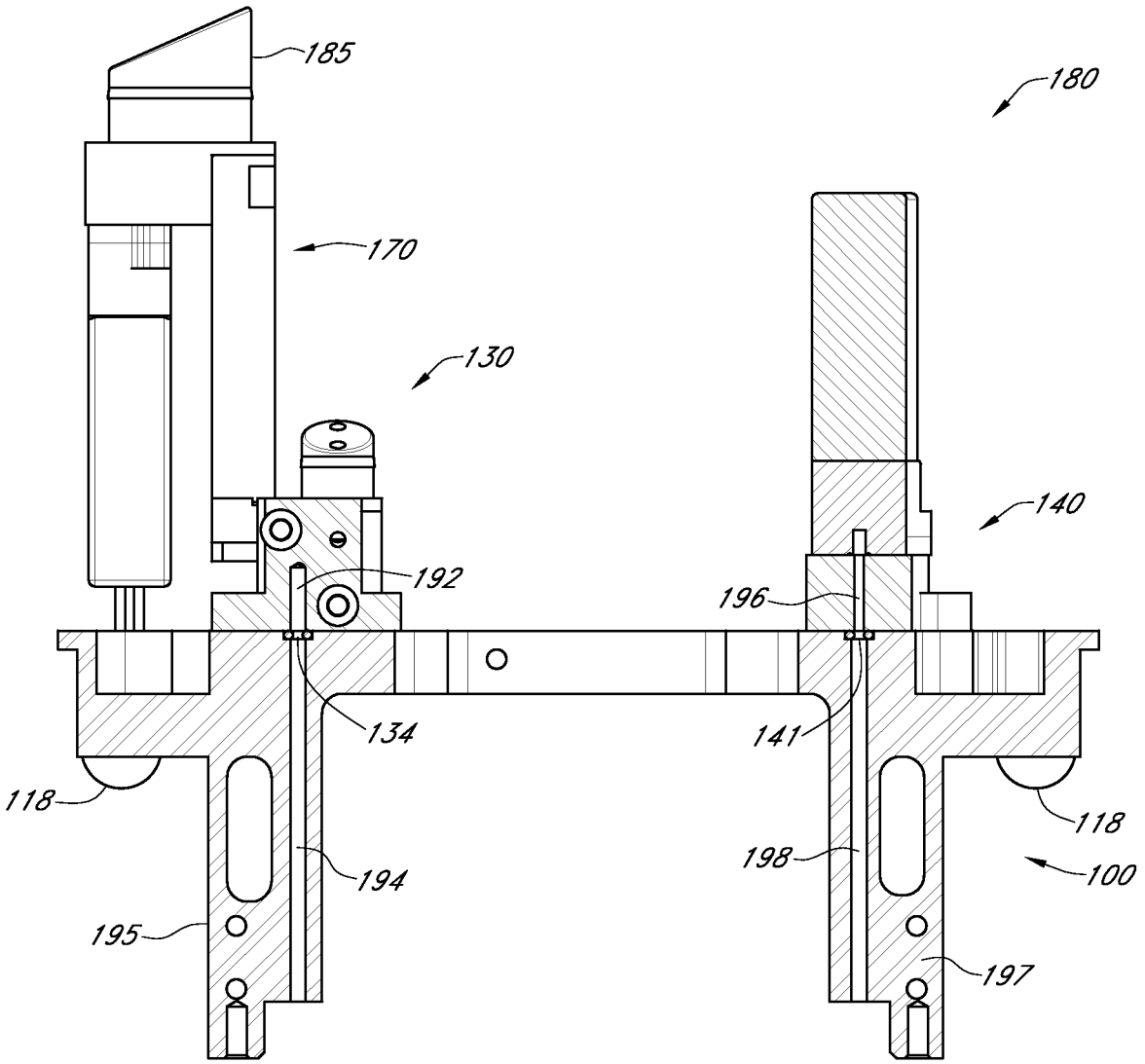
FIG. 9 is a section view through various manifold assemblies in accordance with various embodiments of a printhead unit of the present teachings.

FIG. 9 depicts a section view of the partial perspective view of various embodiments of modular manifold block assembly of FIG. 6. In partial section view of FIG. 9, a set stainless steel balls 118 on the bottom of adapter plate manifold block assembly first member 115 of adapter plate manifold block assembly 100 are depicted. As will be discussed in more detail subsequently, a set of stainless steel balls mounted on first adapter manifold assembly member second surface 92, are part of the kinematic mounting assembly providing for a six-degree of freedom strain-free positioning of printhead unit 1100 in three-space. For various embodiments of self-contained printhead unit 1100, the electrical and pneumatic quick-coupling components, as well as the kinematic mounting components are some of the components that provide for the ready interchangeability of a plurality of printhead units 1100 during a printing process.

In FIG. 9, first fluidic manifold block 130 can have a first fluidic manifold block channel 192, which is in fluid communication with adapter plate manifold block first channel 194 of adapter plate manifold assembly 100. First fluidic manifold block channel 192 can be connected to adapter plate manifold block first channel 194 using fluidic manifold block assembly second port 134. Fluidic manifold block assembly second port 134 can provide a zero dead volume connection between first fluidic manifold block channel 192 and adapter plate manifold block first channel 194, as well as providing a leak-free O-ring seal. Similarly, second fluidic manifold block 140 can have a second fluidic manifold block channel 196, which is in fluid communication with adapter plate manifold block second channel 198 of adapter plate manifold assembly 100. Second fluidic manifold block channel 196 can be connected to adapter plate manifold block second channel 194 using fluidic manifold block assembly fifth port 141. Fluidic manifold block assembly fifth port 141 can provide a zero dead volume connection between second fluidic manifold block channel 196 and adapter plate manifold block second channel 198, as well as providing a leak-free O-ring seal.

Figure 10:
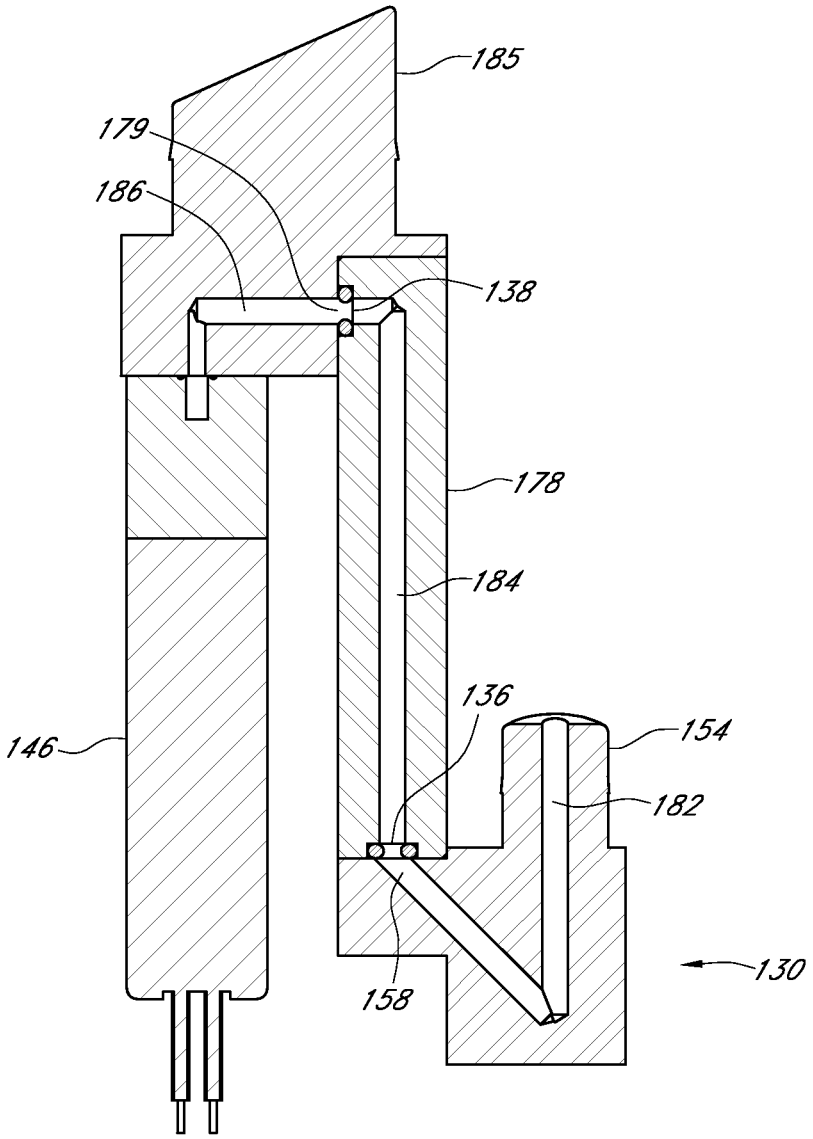
FIG. 10 is an expanded section view through an ink manifold assembly in accordance with various embodiments of a printhead unit of the present teachings.

Further illustration of various embodiments of features of embodiments of fluidic manifold assemblies of the present teaching is shown in FIG. 10, which is a section of bulk ink reservoir assembly 170 as depicted in FIG. 9. For various embodiments of first fluidic manifold block 130, bulk reservoir assembly base channel member 178 of bulk ink reservoir assembly 170 can have bulk reservoir assembly base channel 184. Bulk reservoir assembly base channel 184 can be in fluid communication with bulk ink reservoir base channel 186 of bulk ink reservoir base 185 and primary dispensing reservoir base channel 182 of primary dispensing reservoir base 154. Fluidic manifold block assembly third port 136 can provide a zero dead volume connection between primary dispensing reservoir base channel 182 and bulk reservoir assembly base channel 184, as well as providing a leak-free O-ring seal. Similarly, fluidic manifold block assembly forth port 138 can provide a zero dead volume connection between bulk reservoir assembly base channel 184 and bulk ink reservoir base channel 186, as well as providing a leak-free O-ring seal.

Accordingly, as depicted in FIG. 9 and FIG. 10, various embodiments of manifold block assemblies of the present teachings, such as those described for printhead unit 1000 of FIG. 2 and printhead unit 1100 of FIG. 5, can provide distribution and control using a manifold block having channels fabricate therein. Various embodiments of manifold block assemblies of the present teachings additionally can have a plurality of ports providing for fluid communication, for example, but not limited by, between various channels, as well as valves providing fluid control. Various embodiments of manifold block assemblies of the present teachings can have channels connected using port connections that can provide zero dead volume connection, as well as providing a leak-free O-ring seal. Additionally, for various embodiments of manifold block assemblies according to the present teachings, each component in communication with a manifold, for example, but not limited by, a manifold, a valve, a reservoir, a vacuum source, a gas source, such as an inert gas source, an inkjet printhead assembly, and the like, that are in communication with a port can mounted on a manifold and can be sealed using an O-ring seal, precluding the use of tubing connections thereby. As such, various embodiments of a manifold assembly of the present teachings can minimize undesirable dead volumes, as well as increase printhead unit robustness by avoiding failure modes common to various tubing and tubing connections.

Figure 11:
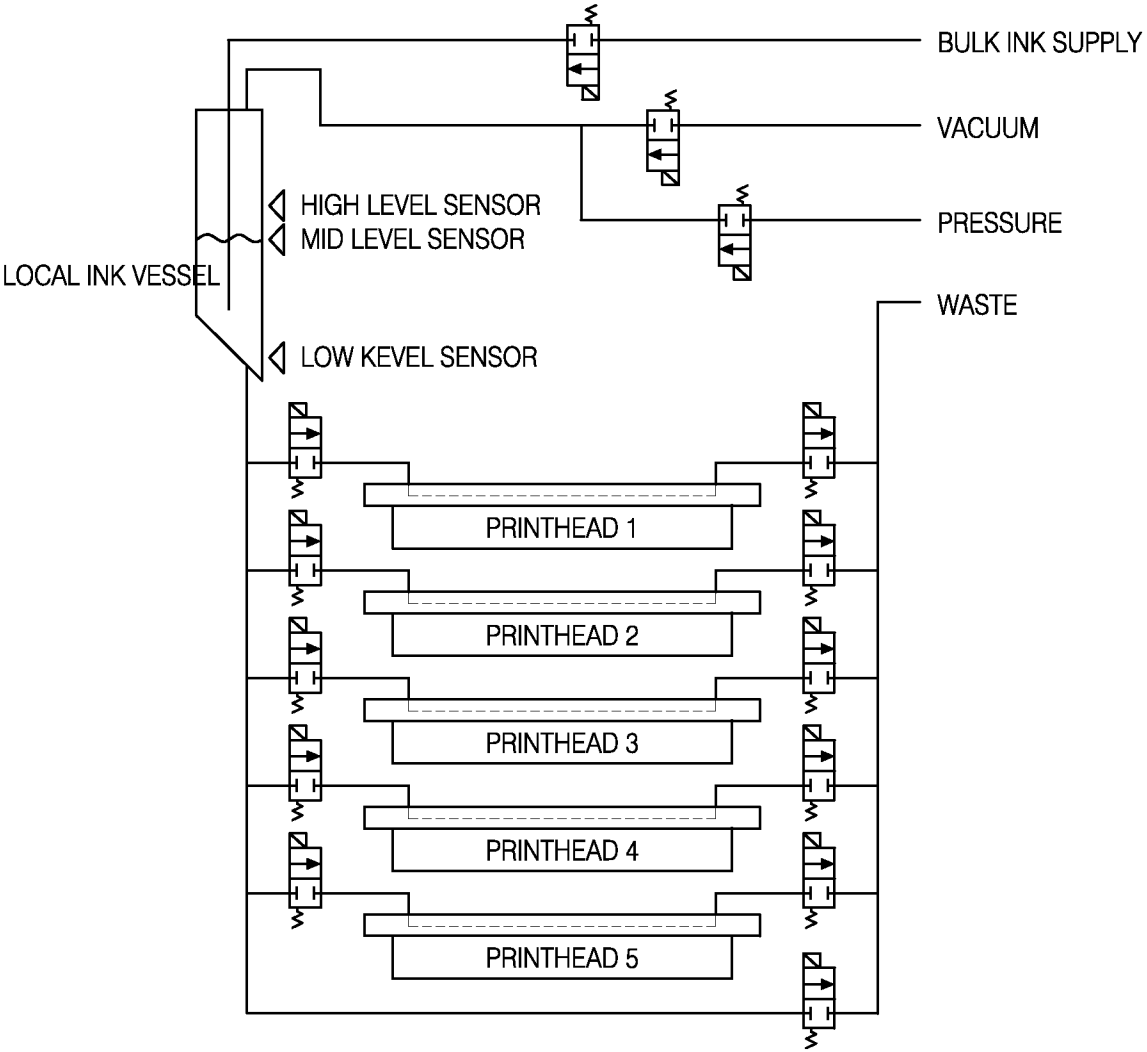
FIG. 11 is a schematic representation of a printhead assembly including a plurality of printheads.
Figure 12A:
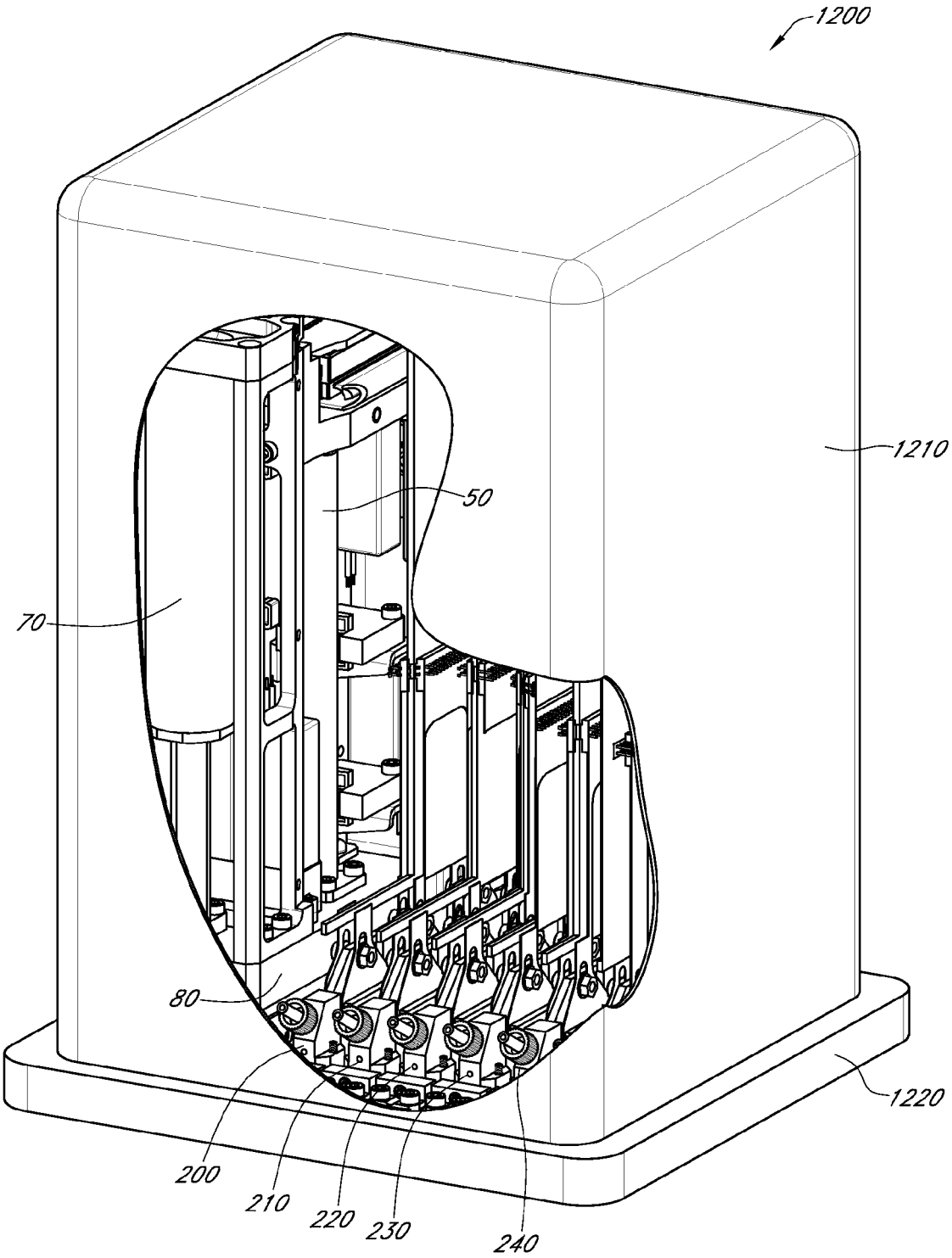
FIG. 12A and FIG. 12B are perspective views of a depicting a printhead assembly including a plurality of printheads.
Figure 12B:
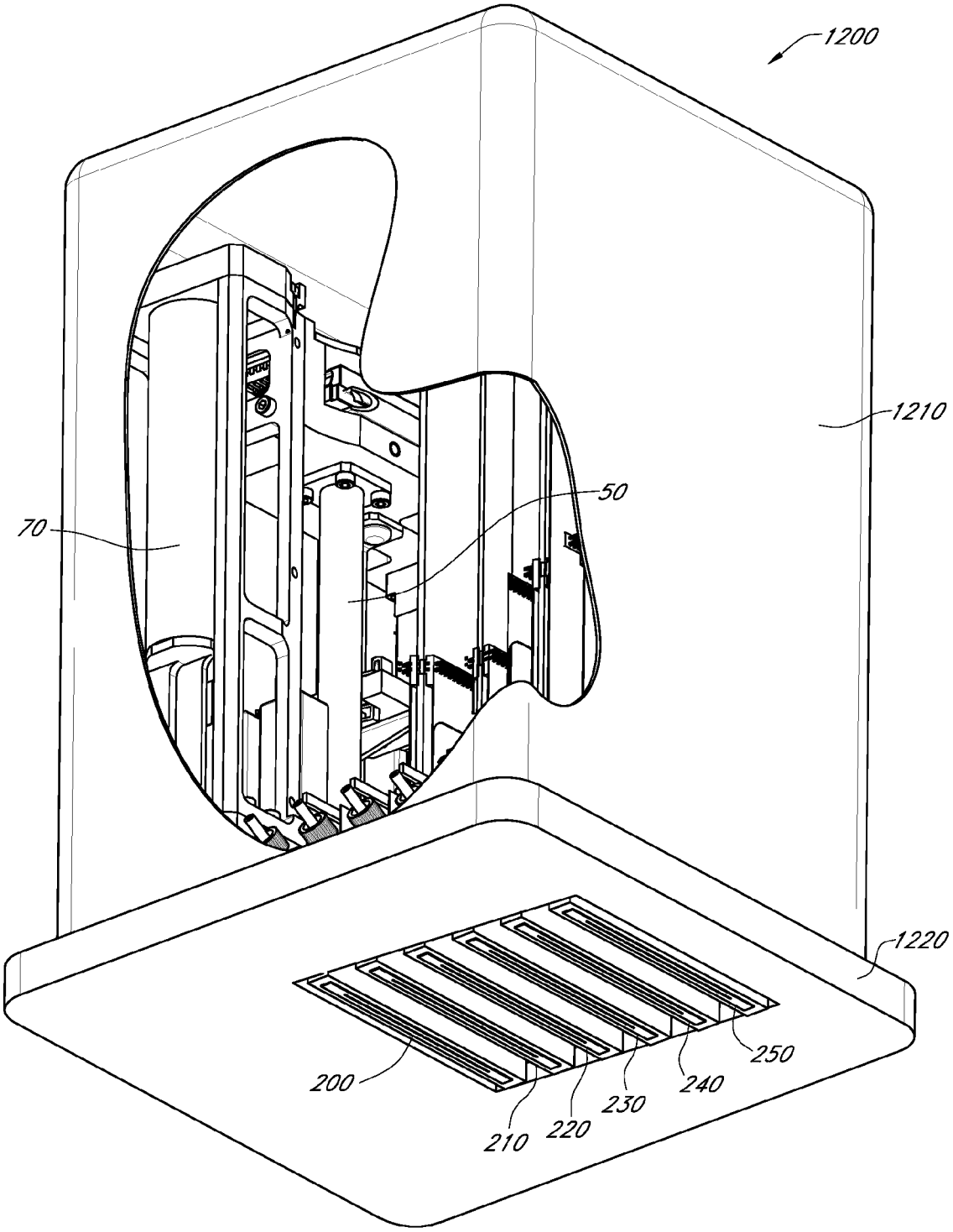

As depicted in FIG. 11, various embodiments of a printhead unit can have a plurality of printheads on each unit. Various embodiments of a printhead unit can have between about 1 to about 30 printheads. A printhead, for example, an industrial inkjet head, can have between about 16 to about 2048 nozzles, which can expel a droplet volume of between about 0.1 pL to about 200 pL. Various embodiments of a printhead unit as depicted in FIG. 11 can have the plurality of printheads mounted on a common manifold. In FIG. 12A, a cut-away perspective view of printhead unit 1200 depicts a printhead unit with five printheads of which four are visible; printhead assembly 200 through printhead assembly 240. FIG. 12B depicts a bottom perspective view of printhead unit 1200, showing how five printheads; printhead 200 through printhead 250 of FIG. 12A would be oriented toward a substrate. As depicted in FIG. 12A and FIG. 12B, printhead unit 1200 can have printhead unit housing 1210, with printhead unit bottom support plate 1220, on which, for example, but not limited by primary dispensing reservoir assembly 50 and bulk ink reservoir assembly 70 can be mounted upon various manifold block assemblies, for example, but not limited by first fluidic manifold block assembly 80 of FIG. 12A. As previously described for printhead unit 1000 of FIG. 2 and printhead unit 1100 of FIG. 5, various embodiments printhead unit 1200 can have a bulk ink reservoir in conjunction with automated sensing and control to provide continuous fluid replenishment, can have a volume sufficient to provide a continuous supply of ink to a primary dispensing reservoir over the course of a printing process.

A printing system that can utilize various embodiments of printhead unit 1000 can include a substrate support apparatus, such as a chuck or a floatation table for supporting a substrate on which the printing is done, and a motion system for controlling the printhead unit position relative to the substrate. In various embodiments of a printing system, a printhead unit 1000 can be mounted, for example, on a gantry or bridge of a multi-axis motion system. For various embodiments of a printing system, a printhead unit 1000 can be mounted, for example, on a gantry of a two-axis motion system. Various embodiments of a printing system can have a printhead unit 1000 mounted to be stationary, while a substrate mounted on a chuck can be moved in relationship to printhead unit 1000. Regardless of how a motion system for controlling the printhead unit position relative to the substrate is implemented, various embodiments of a self-contained printhead unit 1000 must be mounted and clamped in a fashion that provides for the ready interchangeability of a plurality of self-contained printhead unit 1000 into and out of a printing system, as well as providing for stability of printhead unit 1000 during the printing process.

Figure 13A:
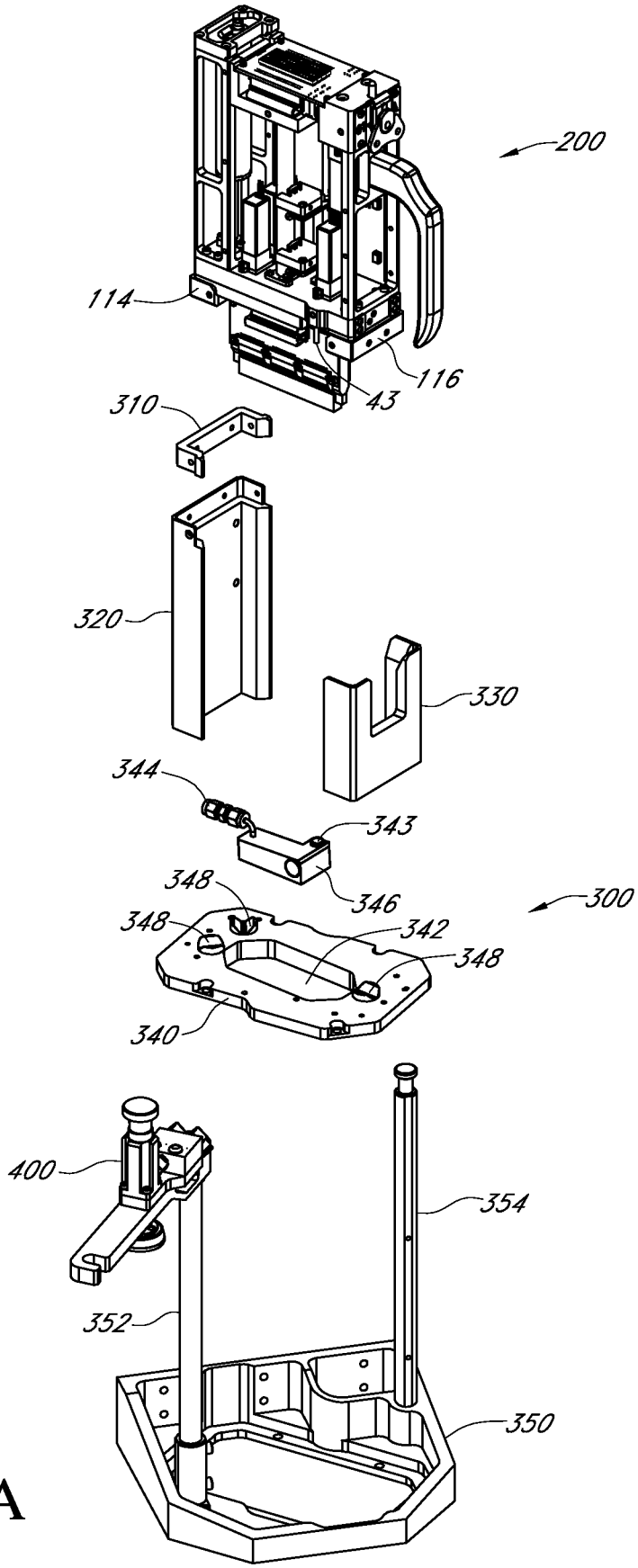
FIG. 13A is an exploded view of a printhead assembly and mount assembly, according to various embodiments.
Figure 13B:
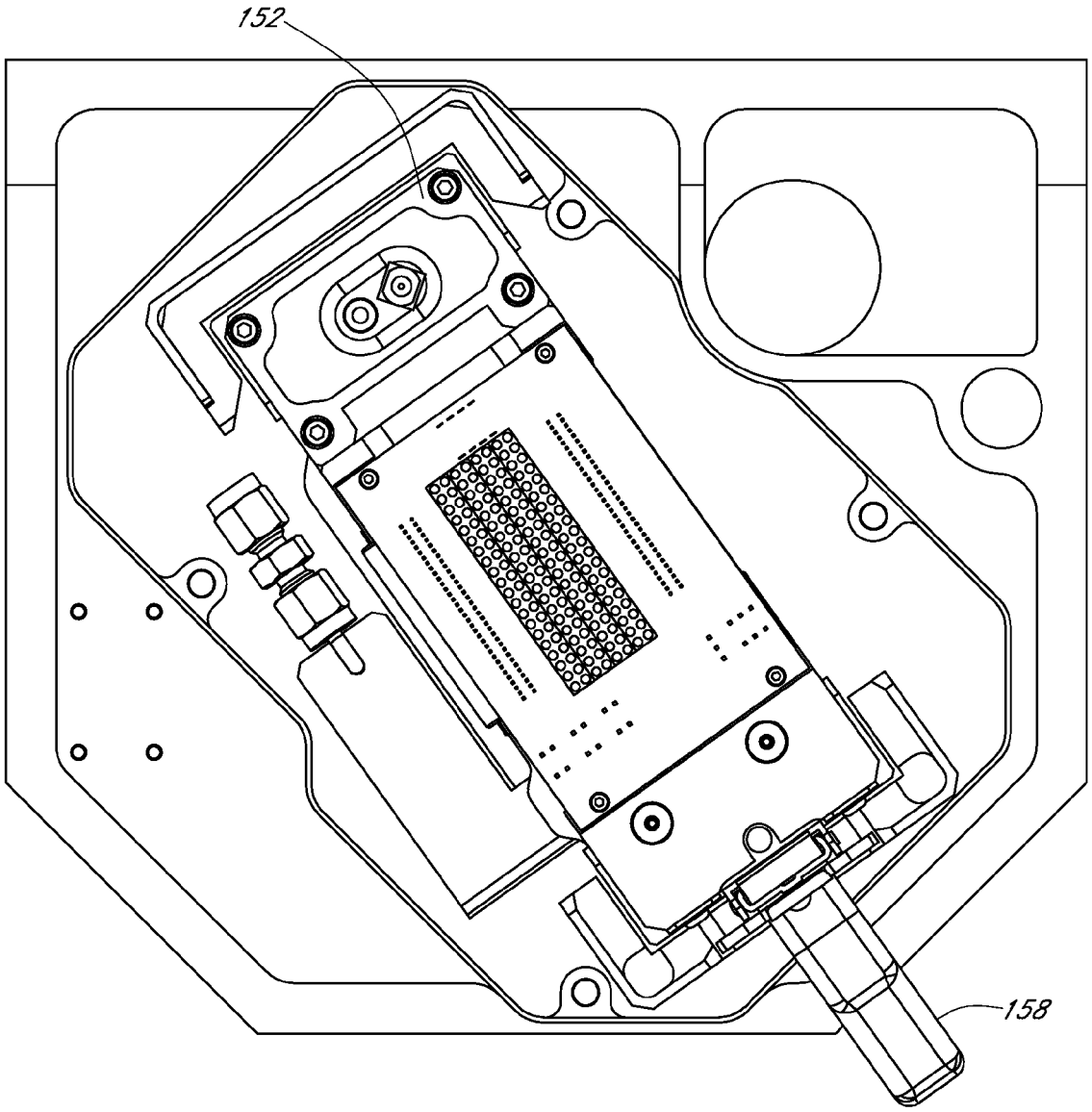
FIG. 13B is a top view of a printhead unit mounted in a mount assembly, according to various embodiments.
Figure 13C:
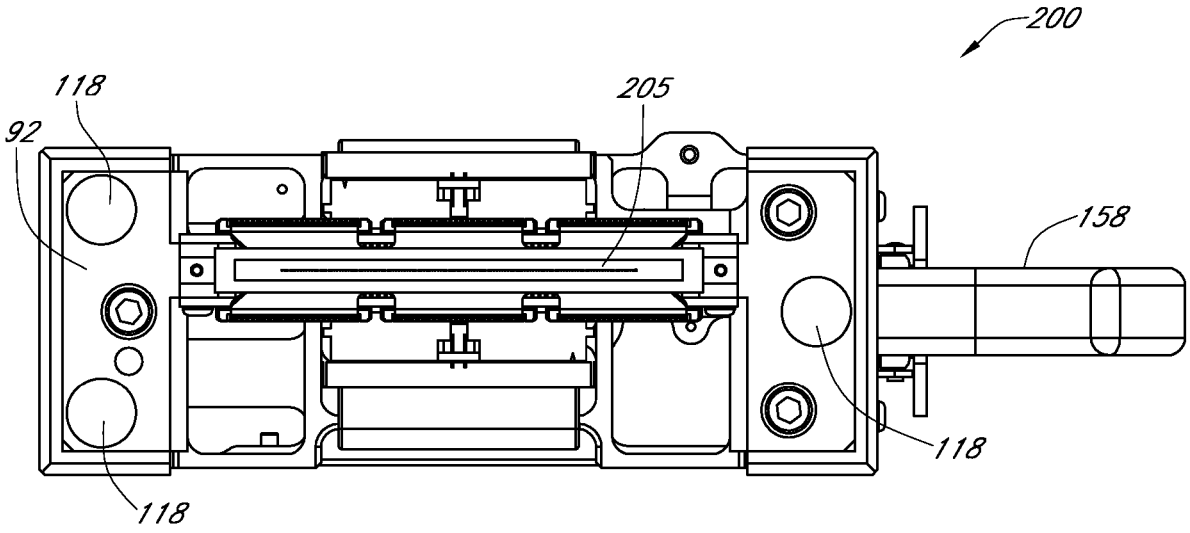
FIG. 13C is a bottom view of a printhead assembly, according to various embodiments.

FIG. 13A through FIG. 13C depict a mounting and clamping assembly 300, according to various embodiments of a printhead unit assembly of the present teachings. Though the principles taught for mounting and clamping assembly 300 of FIG. 13A through FIG. 13C can be utilized with various embodiments of a printhead unit, such as printhead unit 1000 of FIG. 2, printhead unit 1100 of FIG. 5 and printhead unit 1200 of FIG. 12A, one of ordinary skill in the art will appreciate that for the purpose of illustration, mounting and clamping assembly 300 is shown with respect to printhead unit 1000 of FIG. 2.

In that regard, FIG. 13A is an exploded view of printhead unit 1000 in relationship to an exploded view of clamping assembly 300. Various embodiments of printhead unit 1000 can include first guide 114 and second guide 116 on adapter plate assembly manifold 100 (FIG. 3C) for guiding a printhead unit 1000 into a kinematic mount. As one of ordinary skill in the art is apprised, a kinematic mount provides strain-free, highly repeatable positioning of a payload in relation to a fixed position in a mechanical system. Various embodiments of a mounting and clamping assembly 300 provide strain-free positioning of interchangeable printhead unit 1000 for the purpose of precision printing. While providing highly repeatable positioning for printhead unit 1000, various embodiments of a mounting and clamping assembly 300 are additionally designed to enable the integration of printhead unit 1000 into and out of a printing system in a fashion consistent with what the quick-coupling connections provide; ready movement of printhead unit 1000.

As shown in FIG. 13A, various embodiments of mounting and clamping assembly 300 can have a guide frame, which includes guide 310, first guide frame 320 and second guide frame 330. Various embodiments of a guide frame provide for guiding printhead unit 1000 on to base plate 340, while first guide 114 and second guide 116 assist in engaging and guiding printhead unit 1000 into a guide frame. Base plate 340 can have opening 342 for receiving printhead unit 1000 onto a kinematic mount, thereby allowing an end-user selected printhead to be positioned in a printing system for printing. As will be discussed in more detail subsequently, various interchangeable baseplates 340 can have opening 342 positioned to provide for various angles of position of printhead unit 1000 relative to a substrate. Mounting and clamping assembly 300 can have a local waste receptacle 346 mounted on baseplate 340. Local waste receptacle 346 can include port 343 for receiving drain tube 43 of printhead unit 1000, providing contactless engagement of printhead unit 1000 into mounting and clamping assembly 300 at that point of contact, which can be an additional design element enabling ready movement of interchangeable printhead unit 1000 into and out of a printing system without disrupting system performance. Local waste receptacle 346, which in various embodiments of mounting and clamping assembly 300 can be mounted on base plate 340, can include connector 344, which can be connected to a waste bottle. In addition to providing contactless engagement of printhead unit 1000 into mounting and clamping assembly 300, the design of the contactless integration of drain tube 43 with local waste receptacle 346 prevents cross-contamination of inks at the exit end of the fluidic system of printhead unit 1000. The combination of self-contained ink supply provided by an on-board, two-stage ink reservoir system at the input end of ink supply, in conjunction with design of local waste receptacle 346 at the output end prevents cross-contamination of inks for a plurality of interchangeable printhead units 1000. Baseplate 340 can have a set of three kinematic V-groove mounts 348, which as will be discussed in more detail subsequently, are part of a kinematic mount that provides for a six-degree of freedom strain-free positioning of printhead unit 1000 in three-space, as well as ready interchangeability of a plurality of printhead units 1000. For various embodiments of a mounting and clamping assembly 300, baseplate 340 engages with baseplate support arm 350, which can be affixed to a support in a printing system. Baseplate support 350 can include first support post 352, on which a clamping assembly can be attached and second support post 354.

FIG. 13B is a top view of printhead unit 1000 mounted in a mount assembly 300, showing bulk ink reservoir top 122 and support structure assembly handle 158 opposite bulk ink reservoir top 122. As previously discussed, base plate 340 can have opening 342 (FIG. 13A) for receiving printhead unit 1000 onto a kinematic mount, thereby allowing an end-user selected printhead to be positioned in a printing system for printing. As one of ordinary skill in the art is apprised, a different base plate 340, where each base plate can have opening 342 positioned at varying angles can provide an end-user with a selection of base plates that enable a selection of saber angles. The term of art "saber angle" can mean an angle of orientation of a printhead device, such as printhead unit 1000, relative to features on a substrate defining a direction of print, which angle is a non-zero number determined from a plane orthogonal to the direction of printing. According to various embodiments of the present teachings, the saber angle of printhead unit 1000 can be changed to change the number of features per unit area that can be printed on a substrate. In that regard, readily changing the saber angle of printhead unit 1000 by readily changing base plate 340 can be advantageous for providing an end-user the capability to adjust the printing density of per unit area of substrate.

FIG. 13C is a bottom view of printhead unit 1000 according to various embodiments, which show a set of stainless steel balls 118 mounted on first adapter manifold assembly member second surface 92. Recalling in reference to FIG. 13A, baseplate 340 can have a set of three kinematic V-groove mounts 348. The set of stainless steel balls 118 on the bottom of adapter plate manifold block assembly first member 115 of adapter plate manifold block assembly 100 mate with the set of V-groove mounts 348, providing for a six-degree of freedom strain-free positioning of printhead unit 1000 in three-space. As previously mentioned, in addition to providing highly repeatable positioning for printhead unit 1000, various embodiments of a mounting and clamping assembly 300 are additionally designed to enable the integration of printhead unit 1000 into and out of a printing system in order to provide ready movement of printhead unit 1000 without disrupting system performance.

Figure 14:
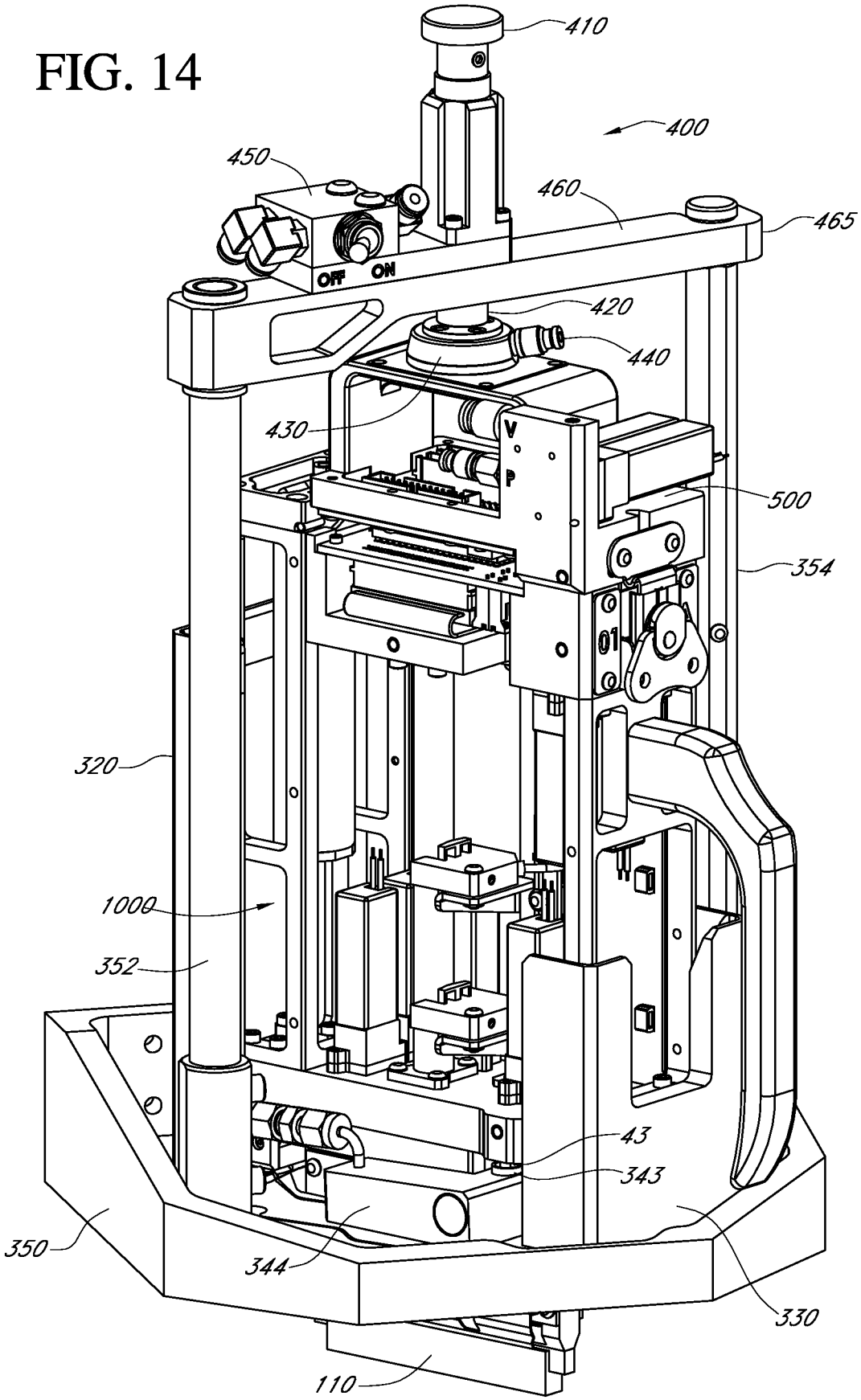
FIG. 14 is a perspective view of a printhead unit mounted and clamped in a mount assembly, according to various embodiments.

FIG. 14 provides a perspective view of printhead unit 1000 in a mounting and clamping assembly 300 (FIG. 13A) which shows the position of the air bearing assembly 400 used for clamping printhead unit 1000 into baseplate support 350. As can be seen in FIG. 14 air bearing assembly 400 can be mounted on air bearing support arm 460, which can be designed to latch onto second air bearing support post 354, and at the same time be readily unlatched either by manual or robotic movement, in order to readily interchange a plurality of printhead units 1000. Air bearing assembly 400 includes air bearing knurl knob 410 for adjusting the height of the air bearing puck 430 attached distal the air bearing knurl knob 410 on air bearing shaft 420. As one of ordinary skill in the art is apprised, a spring mechanism connects air bearing knurl knob 410 and air bearing puck 430 in order to provide a controlled clamping force. Air bearing puck 430 includes air bearing gas supply port 440, from which a gas, such as, but not limited by, an inert gas, can be supplied during initial clamping of printhead unit 1000 in mounting and clamping assembly 300. In various embodiments of mounting and clamping printhead unit 1000 in mounting and clamping assembly 300, the air bearing clamping of printhead unit 1000 in the mounting and clamping assembly provides for a contactless pneumatic clamp providing a stable clamping force during movement of printhead unit 1000 during a printing process. For various embodiments of mounting and clamping printhead unit 1000 in mounting and clamping assembly 300, initially, the air bearing clamping of printhead unit 1000 in mounting and clamping assembly 300 provides for a contactless clamp, preventing any lateral force on printhead unit 1000 during seating of printhead unit 1000 in mounting and clamping assembly 300. After initial seating of printhead unit 1000 has been completed, a gas supply, such as an inert gas, to air bearing puck 430 can be turned-off, while the spring mechanism controllably seats air bearing puck 430 upon top surface of interface assembly 500, thereby providing a stable clamping force during movement of printhead unit 1000 during a printing process. In that regard, the combination of kinematic mounting and strain-free clamping provide for stably positioning printhead unit 1000 during a printing process, as well as providing for repeatable positioning for various embodiments of readily-interchangeable printhead unit 1000.

Figure 15:
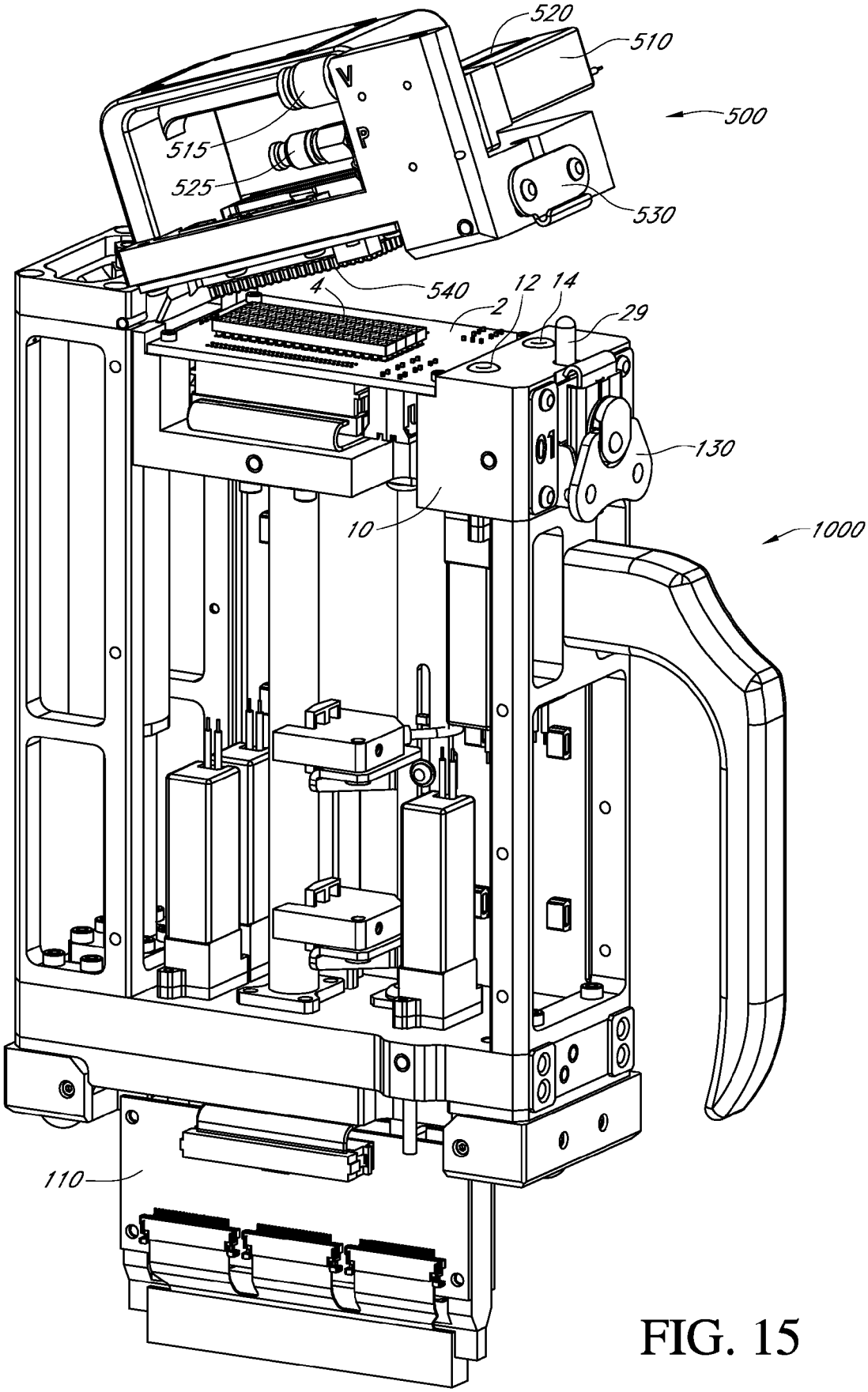
FIG. 15 is a perspective view of an interface assembly of an inkjet printing system, depicting attachment to a printhead unit, according to various embodiments.

In FIG. 15, interface assembly 500 according to various embodiments, is shown readied for engagement with printhead unit 1000. Though the principles taught for interface assembly 500 can be utilized with various embodiments of a printhead unit, such as printhead unit 1000 of FIG. 2, printhead unit 1100 of FIG. 5 and printhead unit 1200 of FIG. 12A, one of ordinary skill in the art will appreciate that for the purpose of illustration, interface assembly 500 is shown with respect to printhead unit 1000 of FIG. 2.

Interface assembly 500 includes first interface assembly valve 510 and vacuum connection 515, as well as second interface assembly valve 520 and connection to a gas source, such as inert gas source 525 for control and connectivity of applied vacuum and inert gas pressure, respectively. Interface assembly additionally includes pogo pin array 540 for electrical connectivity of printhead unit 1000 with an electrical control interface of a printing system. Interface assembly can be readily mounted onto printhead unit 1000, for example, by sliding first interface assembly hinge 550 and second interface assembly hinge 552 (not shown) into first interface assembly hinge grove 551 and second interface assembly hinge groove 553(not shown). According to various embodiments, interface assembly 500 can be guided into position over printhead unit 1000 with guide pin 29. Interface assembly 500 can be latched to printhead unit 1000 with the use of draw latch 127 in connection with draw latch lip 530. When positioned in place, interface assembly 500 connects pogo pin array 540 with pogo pin pad 4, and positions complementary ports for vacuum and inert gas connectivity from interface assembly 500 (not shown) with vacuum port 12 and inert gas port 14 of pneumatic manifold block 10. For various embodiments of printhead unit 1000 and interface assembly 500, complementary ports for vacuum and inert gas connectivity from interface assembly 500 with vacuum port 12 and inert gas port 14 of pneumatic manifold block 10 can be sealed using O-ring seals. According to various embodiments of the present teachings, interface assembly 500 can be readily disconnected from printhead unit 1000, and remain as part of a printing system.

Figure 16:
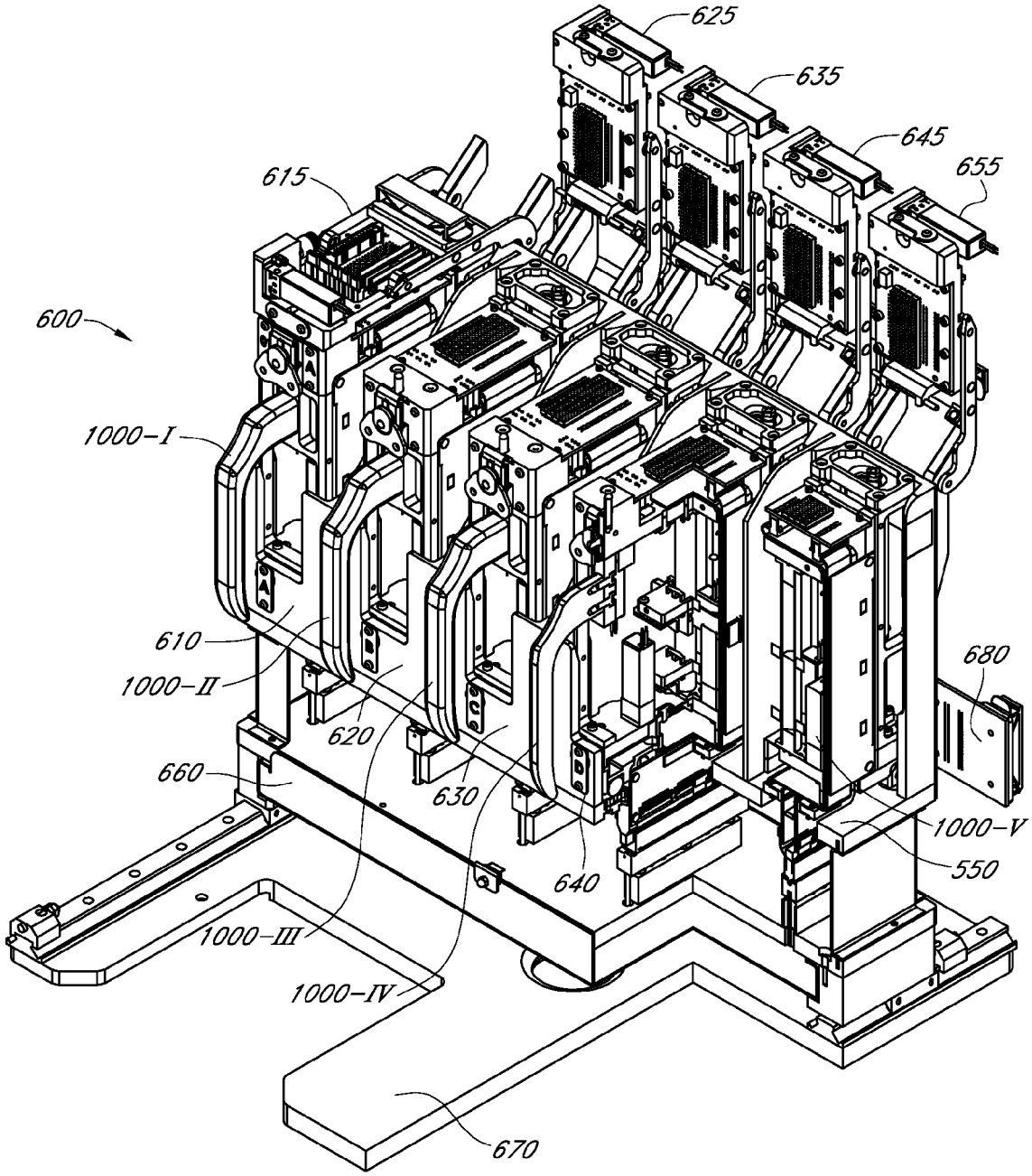
FIG. 16 is a perspective view of a printhead unit capping station, according to various embodiments.

In FIG. 16, capping station assembly 600 is depicted, which according to various embodiments of the present teachings can be a maintenance module for maintaining a plurality of printhead units according to the present teachings in operable condition while not in use in a printing system. Though the principles taught for capping station assembly 600 can be utilized with various embodiments of a printhead unit, such as printhead unit 1000 of FIG. 2, printhead unit 1100 of FIG. 5 and printhead unit 1200 of FIG. 12A, one of ordinary skill in the art will appreciate that for the purpose of illustration, capping station assembly 600 is shown with respect to printhead unit 1000 of FIG. 2.

According to various embodiments of capping station assembly 600, each of a plurality of printhead units 1000, indicated as 1000-I to 1000-V in FIG. 8 can be docked into each of a specific capping station, indicated as 610 to 650, for each of a plurality of printhead units 1000-I to 1000-V, respectively. When placed in a capping station position, each printhead unit 1000 can be connected to the electrical and vacuum connections located on the hinged assembly, indicated as 615 to 655 for each of a plurality of printhead units 1000-I to 1000-V, respectively. According to various embodiments of a capping station assembly 600, electrical power can be provided to each of the of the electrical and vacuum hinged assemblies, so that a periodic firing pulse to each nozzle of in each of an end-user selected printhead in each of printhead units 1000-I to 1000-V can be applied while a printhead unit can be docked, in order to ensure that the nozzles remain primed and do not clog. In that regard, storage of each of a plurality of printhead units 1000 in a capping station assembly 600 can ensure that each printhead unit is readily available as an interchangeable unit for a printing process.

Various embodiments of a printhead unit assembly that can include a printhead unit, mounting and clamping assembly, and an interface assembly can be utilized on various embodiments of a printing system. An OLED inkjet printing system can be comprised of several devices and apparatuses, which allow the reliable placement of ink drops onto specific locations on a substrate. These devices and apparatuses can include, but are not limited to, a print head assembly, ink delivery system, motion system, substrate loading and unloading system, and print head maintenance system. A print head assembly consists of at least one ink jet head, with at least one orifice capable of ejecting droplets of ink at a controlled rate, velocity, and size. The printhead can be fed by an ink supply system which provides ink to a printhead. Printing requires relative motion between the print head assembly and the substrate. This can be accomplished with a motion system, typically a gantry or split axis XYZ system. Either the print head assembly can move over a stationary substrate (gantry style), or both the print head and substrate can move, in the case of a split axis configuration. In another embodiment, the print station can be fixed, and the substrate can move in the X and Y axes relative to the print heads, with Z axis motion provided either at the substrate or the print head. As the print heads move relative to the substrate, droplets of ink are ejected at the correct time to be deposited in the desired location on the substrate. The substrate can be inserted and removed from the printer using a substrate loading and unloading system. Depending on the printer configuration, this can be accomplished with a mechanical conveyor, a substrate floatation table, or a robot with end effector. A print head maintenance system can be comprised of several subsystems which allow for such maintenance tasks, such as, but not limited by, drop volume calibration, elimination of excess ink from a printhead nozzle plate surface, and priming for ejecting ink into a waste basin.

Figure 17:
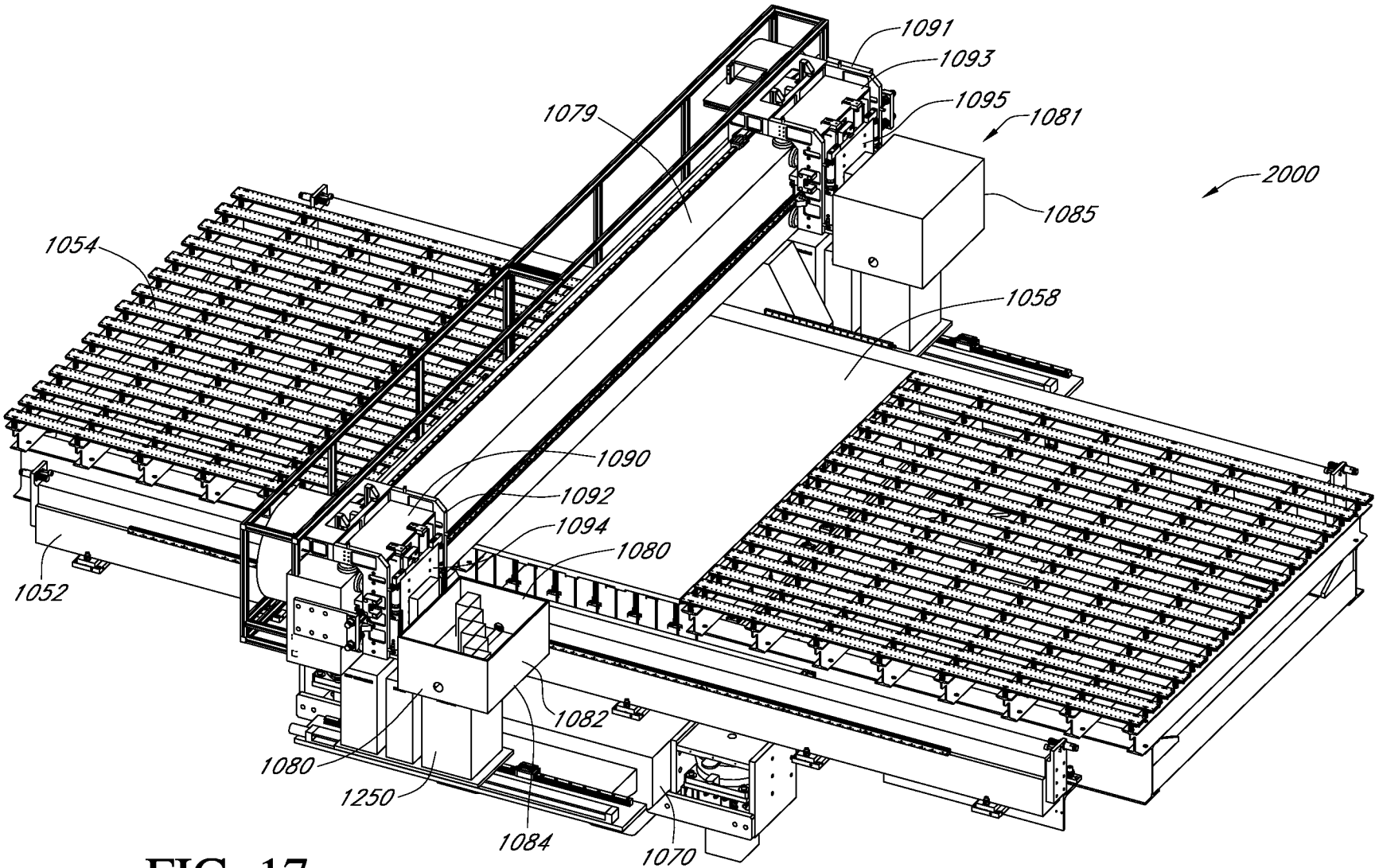
FIG. 17 is perspective view of a printing system that can utilize various printhead units according to various embodiments of a printhead unit of the present teachings.

FIG. 17 is a perspective view of OLED inkjet printing system 2000. Various embodiments of a printing system of the present teachings can be comprised of several devices and apparatuses, which allow the reliable placement of ink drops onto specific locations on a substrate, such as substrate 1058, shown proximal to substrate floatation table 1054. Substrate floatation table 1054 can be used for the frictionless conveyance of substrate 1058. Given the variety of components that can comprise OLED printing system 2000, various embodiments of OLED printing system 2000 can have a variety of footprints and form factors. According to various embodiments of an OLED inkjet printing system, a variety of substrate materials can be used for substrate 1058, for example, but not limited by, a variety of glass substrate materials, as well as a variety of polymeric substrate materials.

OLED printing system 2000 can comprise, for example, base 1070 as well as bridge 1079, which can support first printhead assembly positioning system 1090 and second printhead assembly positioning system 1091. First printhead assembly positioning system 1090, for positioning first printhead assembly 1080 over substrate 1058, can include first X-axis carriage 1092 and first Z-axis moving plate 1094, onto which first printhead assembly enclosure 1084 can be mounted. Second printhead assembly positioning system 1091 can be similarly configured for controlling the X-Z axis movement of second printhead assembly 1081, and can include first X-axis carriage 1091 and first Z-axis moving plate 1093, onto which first printhead assembly enclosure 1085 can be mounted. As depicted in FIG. 17 for first printhead assembly 1080, where first printhead assembly enclosure 1084, is depicted in partial view, various embodiments of a printhead assembly can have a plurality of printhead devices 1082 mounted therein. For various embodiments of printing system 2000, a printhead assembly can include between about 1 to about 60 printhead devices, where each printhead device can have between about 1 to about 30 printheads in each printhead device. Given the sheer number of printhead devices and printheads requiring continual maintenance, first maintenance system assembly 1250 can be seen positioned for ready access to first printhead assembly 1080. For various embodiments of OLED printing system 2000, bridge 1079 can support first printhead assembly positioning system 1090 and second positioning system 1091. For various embodiments of OLED printing system 2000, there can be a single positioning system and a single printhead assembly. For various embodiments of OLED printing system 2000, there can be a single printhead assembly, for example, either of first printhead assembly 1080 and second printhead assembly 1081, while a camera system for inspecting features of substrate 1058 can be mounted to a second positioning system.

Figure 18:
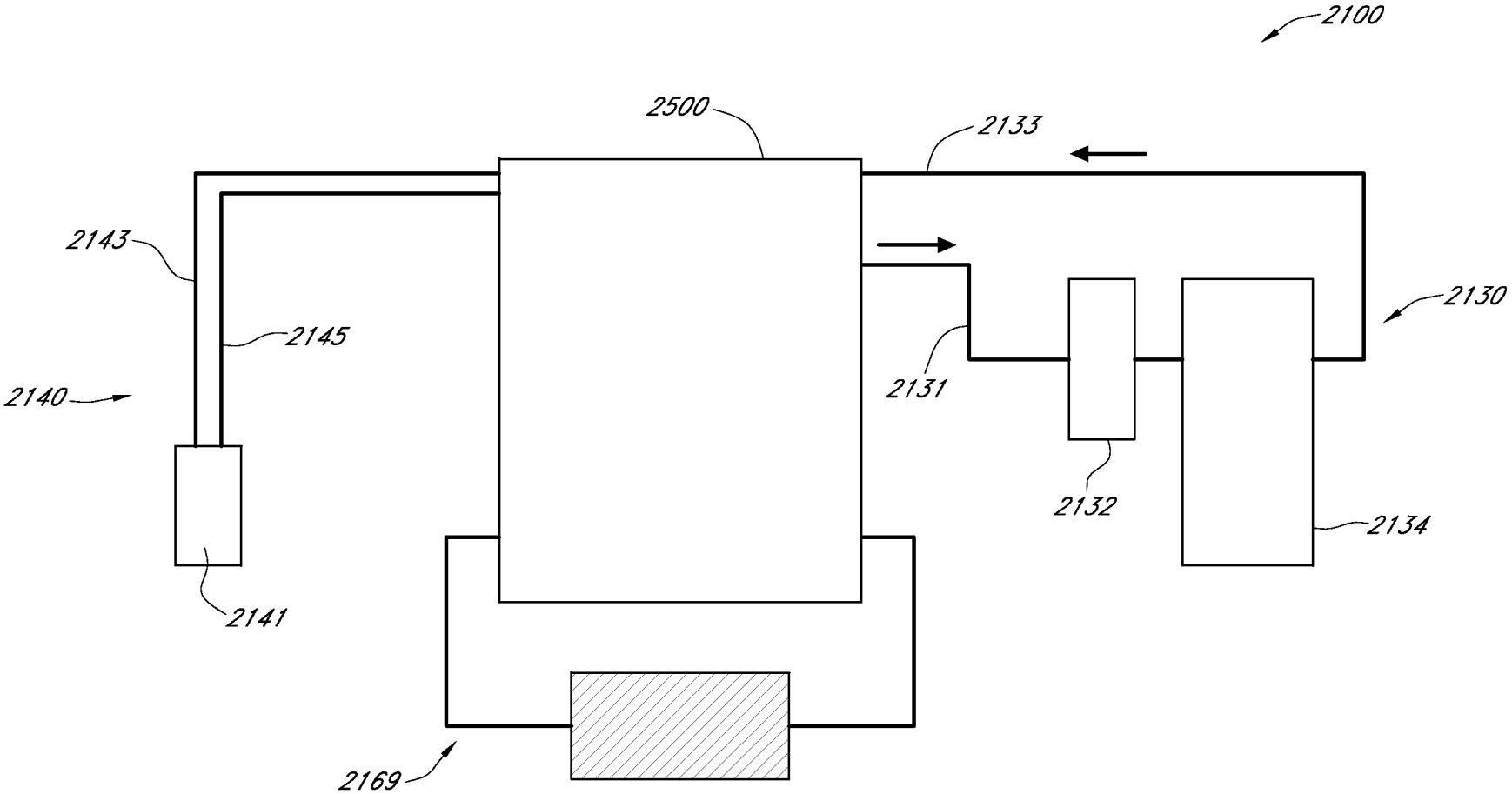
FIG. 18 is a schematic representation of a gas enclosure assembly and system that can house a printing system that can utilize various printhead units according to various embodiments of a printhead unit of the present teachings.

FIG. 18 is a schematic representation of gas enclosure assembly and system 2100 that can house printing system 2000 of FIG. 17. FIG. 17 is a schematic diagram showing gas enclosure assembly and system 2100. Various embodiments of a gas enclosure assembly and system 2100 can comprise a gas enclosure assembly 2500 according to the present teachings, a gas purification loop 2130 in fluid communication gas enclosure assembly 2500, and at least one thermal regulation system 2140. Additionally, various embodiments of a gas enclosure assembly and system can have pressurized inert gas recirculation system 2169, which can supply inert gas for operating various devices, such as a substrate floatation table for an OLED printing system. Various embodiments of a pressurized inert gas recirculation system 2169 can utilize a compressor, a blower and combinations of the two as sources for various embodiments of inert gas recirculation system 2169. Additionally, gas enclosure assembly and system 2100 can have a filtration and circulation system internal to gas enclosure assembly and system 2100 (not shown).

As depicted in FIG. 18, for various embodiments of gas enclosure assembly 2100 according to the present teachings, gas purification loop 2130 includes outlet line 2131 from gas enclosure assembly 2500, to a solvent removal component 2132 and then to gas purification system 2134. Inert gas purified of solvent and other reactive gas species, such as oxygen and water vapor, are then returned to gas enclosure assembly 2500 through inlet line 2133. Gas purification loop 2130 may also include appropriate conduits and connections, and sensors, for example, oxygen, water vapor and solvent vapor sensors. A gas circulating unit, such as a fan, blower or motor and the like, can be separately provided or integrated, for example, in gas purification system 2134, to circulate gas through gas purification loop 2130. According to various embodiments of a gas enclosure assembly, though solvent removal system 2132 and gas purification system 2134 are shown as separate units in the schematic shown in FIG. 17, solvent removal system 2132 and gas purification system 2134 can be housed together as a single purification unit. Thermal regulation system 2140 can include at least one chiller 2141, which can have fluid outlet line 2143 for circulating a coolant into a gas enclosure assembly, and fluid inlet line 2145 for returning the coolant to the chiller.

For various embodiments of gas enclosure assembly 2100, a gas source can be an inert gas, such as nitrogen, any of the noble gases, and any combination thereof. For various embodiments of gas enclosure assembly 2100, a gas source can be a source of a gas such as clean dry air (CDA). For various embodiments of gas enclosure assembly 2100, a gas source can be a source supplying a combination of an inert gas and a gas such as CDA. Various embodiments of gas enclosure assembly and system 2100 can maintain levels for each species of various reactive gas species, including various reactive atmospheric gases, such as water vapor and oxygen, as well as organic solvent vapors at 100 ppm or lower, for example, at 10 ppm or lower, at 1.0 ppm or lower, or at 0.1 ppm or lower. Further, various embodiments of a gas enclosure assembly can provide a low particle environment meeting ISO 14644 Class 3 and Class 4 clean room standards.

Accordingly, as given by the present teachings, design features for various embodiments of a self-contained printhead unit, including an on-board fluidic system, quick-coupling electrical and pneumatic interfacing, in conjunction with the design features of various embodiments of the kinematic mounting and air bearing clamping assembly, as well as contactless integration to a waste assembly, together provide for the ready interchangeability of a plurality of printhead units in a printing system during a printing process, while at the same time preventing cross-contamination of a plurality of end-user selected inks filing each of a plurality of printhead units.

While the principles of various embodiments of a printhead unit, a mounting and clamping assembly, an interface assembly and an industrial inkjet thin film printing system have been described in connection with specific embodiments, it should be understood clearly that these descriptions are made only by way of example and are not intended to limit the scope of the teachings. What has been disclosed herein has been provided for the purposes of illustration and description. It is not intended to be exhaustive or to limit what is disclosed to the precise forms described. Many modifications and variations will be apparent to the practitioner skilled in the art. What is disclosed was chosen and described in order to best explain the principles and practical application of the disclosed embodiments of the art described, thereby enabling others skilled in the art to understand the various embodiments and various modifications that are suited to the particular use contemplated. It is intended that the scope of what is disclosed be defined by the following claims and their equivalence.

What is claimed is:

1. A printhead unit for industrial inkjet printing comprising:

a fluidic system comprising:

a pneumatic assembly manifold block assembly proving distribution of control, said pneumatic manifold block assembly including a first surface and a second surface and having a plurality of channels fabricated therein, wherein the pneumatic manifold block assembly is ported for communication with a manifold component selected from a valve, a reservoir, a vacuum source, and an inert gas source;

a fluidic manifold block assembly, said fluidic manifold block assembly comprising a first surface and a second surface and having a plurality of channels fabricated therein, wherein the fluidic manifold block assembly is ported for communication with a manifold component selected from a valve, a reservoir, a printhead assembly, and a waste system; and a primary dispensing reservoir including at least one inlet port and at least one outlet port, wherein the primary dispensing reservoir is in fluid communication with the pneumatic manifold block assembly and the fluidic manifold block assembly;

an electrical interface plate including a first surface for receiving electrical interconnections and a second surface adjoining the first surface of the pneumatic manifold block assembly, wherein the first surface for receiving electrical interconnections is quick-coupling adapted; and an adaptor plate manifold assembly comprising a first member adjoining the second surface of the fluidic manifold block assembly and a second member configured to receive the printhead assembly, wherein the adapter plate manifold assembly is in fluid communication with the primary dispensing reservoir and the printhead assembly.

2. The printhead unit of claim 1, wherein the communication between the pneumatic manifold block assembly and the manifold component selected from a valve, a reservoir, a vacuum source, and an inert gas source comprises a port connection with an O-ring seal.

3. The printhead unit of claim 1, wherein the communication between the fluidic manifold block assembly and the manifold component selected from a valve, a reservoir, a printhead, and a waste system comprises a port connection with an O-ring seal.

4. The printhead unit of claim 1, wherein the adaptor plate manifold assembly provides a mating surface for mounting the printhead unit in a kinematic mount.

5. The printhead unit of claim 1, wherein the printhead unit has an identification code for accessing operational information related to the printhead unit.

6. The printhead unit of claim 5, wherein the operational information related to the printhead unit is stored on a memory.

7. The printhead unit of claim 6, wherein the memory is a device located on the printhead unit.

8. The printhead unit of claim 1, further comprising a bulk ink reservoir including at least one inlet port and at least one outlet port, wherein the bulk ink reservoir is in fluid communication with the primary dispensing reservoir and the fluidic manifold block assembly.

9. The printhead unit of claim 1, wherein the primary dispensing reservoir has at least one liquid level indicator for maintaining a defined fill level for the primary dispensing reservoir, wherein ink from the bulk reservoir continuously replenishes the primary dispensing reservoir to the defined fill level.

10. The printhead unit of claim 1, wherein the first surface of the electrical interface plate, which first surface is quick-coupling adapted, includes a pogo pin pad.

11. The printhead unit of claim 1, wherein the pneumatic manifold block assembly comprises:

a first manifold port in communication with the vacuum source, a second manifold port in communication with the inert gas source, and a third manifold port in fluid communication with the inlet port of the primary dispensing unit; and a first valve of the pneumatic manifold block assembly, said first valve controlling both the fluid communication between the inert gas source and the primary dispensing reservoir and the fluid communication between a second valve and the primary dispensing reservoir, wherein the second valve of the pneumatic manifold block assembly controls the communication between the first valve and the vacuum source.

12. The printhead unit of claim 11, wherein the fluidic manifold block assembly comprises:

a first manifold port in fluid communication with an outlet port of the primary dispensing reservoir and a second manifold port in fluid communication with an inlet port of the inkjet head assembly, wherein a first valve of the fluid manifold block controls communication between the primary dispensing unit and the inkjet head assembly; and a third manifold port in fluid communication with an outlet port of inkjet head assembly and a forth manifold port in fluid communication with a waste drain tube, wherein a second valve of the fluid manifold block controls communication between the inkjet head assembly and the waste drain tube.

13. The printhead unit of claim 11, wherein the fluidic manifold block assembly comprises:

a bulk reservoir including an inlet port, a vent and an outlet port, wherein the bulk reservoir is in fluid communication with the primary dispensing reservoir;

a first manifold port in fluid communication with an outlet port of the bulk reservoir and a second manifold port in fluid communication with an inlet port of primary dispensing reservoir, wherein a first valve of the fluid manifold block controls communication between the bulk reservoir and the primary dispensing unit;

a third manifold port in fluid communication with an outlet port of the primary dispensing reservoir and a forth manifold port in fluid communication with an inlet port of the inkjet head assembly, wherein a second valve of the fluid manifold block controls communication between the primary dispensing unit and the inkjet head assembly; and a fifth manifold port in fluid communication with an outlet port of inkjet head assembly and a sixth manifold port in fluid communication with a waste drain tube, wherein a third valve of the fluid manifold block controls communication between the inkjet head assembly and the waste drain tube.

14. The printhead unit of claim 13, further comprising a liquid level indicator for maintaining a defined fill level for the primary dispensing reservoir, wherein ink from the bulk reservoir continuously replenishes the primary dispensing reservoir to the defined fill level.

* * * * *